US008033425B2

(12) United States Patent
Gelardi

(10) Patent No.: US 8,033,425 B2
(45) Date of Patent: Oct. 11, 2011

(54) DISPENSING CONTAINER

(75) Inventor: John Anthony Gelardi, Wake Forest, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 434 days.

(21) Appl. No.: 12/042,215

(22) Filed: Mar. 4, 2008

(65) Prior Publication Data

US 2009/0223989 A1 Sep. 10, 2009

(51) Int. Cl.
*A47F 1/04* (2006.01)

(52) U.S. Cl. ..... 221/263; 221/154; 221/256; 221/277

(58) Field of Classification Search ..... 221/1, 22, 221/65, 67, 151, 152, 154, 191, 194, 208, 221/246, 251, 255, 256, 257, 261, 263, 268, 221/269, 272, 277, 288, 289, 294, 295, 299, 221/301, 303, 306, 309, 311
See application file for complete search history.

(56) References Cited

U.S. PATENT DOCUMENTS

| | | | | |
|---|---|---|---|---|
| 194,197 | A | 8/1877 | Villaret | |
| 1,701,556 | A | 2/1929 | Hammett | |
| 1,837,722 | A | 12/1931 | McAtree | |
| 2,090,530 | A | 8/1937 | Guffey et al. | |
| 2,653,706 | A * | 9/1953 | Aggson | 221/264 |
| 2,769,565 | A | 11/1956 | Sottile | |
| 3,563,412 | A | 2/1971 | James | |
| 3,696,917 | A | 10/1972 | Levi | |
| 3,761,009 | A | 9/1973 | Resenburg | |
| 3,782,584 | A | 1/1974 | Swenson et al. | |
| 3,895,737 | A | 7/1975 | Phillips | |
| B536,923 | I5 | 3/1976 | Mayled | |
| 4,057,145 | A | 11/1977 | Wray et al. | |
| 4,154,365 | A | 5/1979 | Lorca | |
| 4,284,204 | A | 8/1981 | Carey, Jr. | |
| 4,437,579 | A | 3/1984 | Obland | |
| 4,561,544 | A * | 12/1985 | Reeve | 206/540 |
| 4,572,376 | A | 2/1986 | Wrennall | |
| 4,611,727 | A | 9/1986 | Graff | |
| 4,705,165 | A | 11/1987 | Thieke | |
| 4,939,860 | A | 7/1990 | Ackeret | |
| 4,967,909 | A | 11/1990 | McKibben | |
| 5,080,222 | A | 1/1992 | McNary | |
| 5,082,137 | A | 1/1992 | Weinstein | |
| 5,108,006 | A | 4/1992 | Tieke et al. | |
| 5,174,471 | A | 12/1992 | Kozlowski et al. | |

(Continued)

FOREIGN PATENT DOCUMENTS

| | | | |
|---|---|---|---|
| CH | 180218 | A | 10/1935 |

(Continued)

*Primary Examiner* — Gene Crawford
*Assistant Examiner* — Kelvin Randall, Jr.
(74) *Attorney, Agent, or Firm* — Womble Carlyle Sandridge & Rice, PLLC

(57) ABSTRACT

A container adapted for dispensing a product is provided, the container including a storage compartment configured to store a plurality of units of a product to be dispensed; a dispensing chamber for receiving at least one unit of the product, the dispensing chamber configured for movement between a closed and locked position and a dispensing position; a dispensing pathway between the storage compartment and the dispensing chamber, the dispensing pathway sized for passage of at least one unit of the product; a locking mechanism adapted for releasably locking the dispensing chamber in the closed and locked position; and a blocking member operatively positioned to block the dispensing pathway when the dispensing chamber is in the dispensing position.

26 Claims, 23 Drawing Sheets

U.S. PATENT DOCUMENTS

| | | | | |
|---|---|---|---|---|
| 5,275,291 | A | 1/1994 | Sledge | |
| 5,657,901 | A | 8/1997 | Farside | |
| 5,782,359 | A | 7/1998 | McAllister et al. | |
| 5,816,441 | A | 10/1998 | Farside | |
| 5,897,025 | A | 4/1999 | Flewitt et al. | |
| 5,909,822 | A | 6/1999 | George et al. | |
| 5,915,560 | A | 6/1999 | George et al. | |
| 6,050,449 | A | 4/2000 | Kanj | |
| 6,131,765 | A | 10/2000 | Barry et al. | |
| 6,155,454 | A | 12/2000 | George et al. | |
| 6,267,265 | B1 | 7/2001 | Issa | |
| 6,382,460 | B1 | 5/2002 | Gonzalez | |
| 6,460,693 | B1 | 10/2002 | Harrold | |
| 6,527,138 | B2 | 3/2003 | Pawlo et al. | |
| 6,564,967 | B1 * | 5/2003 | Stringfield et al. | 221/229 |
| 6,641,031 | B2 | 11/2003 | Evans et al. | |
| 6,758,338 | B2 | 7/2004 | Lien | |
| 6,863,175 | B2 | 3/2005 | Gelardi | |
| 6,913,149 | B2 | 7/2005 | Gelardi et al. | |
| 6,976,576 | B2 | 12/2005 | Intini | |
| 7,159,720 | B2 | 1/2007 | Pearson | |
| 7,216,776 | B2 | 5/2007 | Gelardi | |
| 7,287,666 | B2 | 10/2007 | De Laforcade | |
| 7,320,413 | B2 | 1/2008 | Fusi | |
| 7,533,785 | B2 * | 5/2009 | Smith et al. | 221/263 |
| 7,584,843 | B2 | 9/2009 | Kutsch et al. | |
| 7,740,132 | B2 | 6/2010 | Oono et al. | |
| 2002/0175195 | A1 | 11/2002 | Cole | |
| 2003/0106900 | A1 | 6/2003 | Storz | |
| 2004/0074917 | A1 | 4/2004 | McHutchinson | |
| 2004/0217024 | A1 | 11/2004 | Arnarp et al. | |
| 2005/0011773 | A1 | 1/2005 | Intini | |
| 2005/0173272 | A1 | 8/2005 | Lemmons, IV | |
| 2005/0183981 | A1 | 8/2005 | Gelardi | |
| 2005/0205598 | A1 * | 9/2005 | Gelardi | 221/263 |
| 2006/0060480 | A1 | 3/2006 | Budd | |
| 2006/0118589 | A1 | 6/2006 | Arnarp et al. | |
| 2006/0124658 | A1 | 6/2006 | Coe et al. | |
| 2006/0243611 | A1 | 11/2006 | Wu | |
| 2007/0068960 | A1 | 3/2007 | Valentine et al. | |
| 2007/0163911 | A1 | 7/2007 | Gelardi | |
| 2007/0246382 | A1 | 10/2007 | He | |
| 2007/0246383 | A1 | 10/2007 | He | |
| 2007/0277299 | A1 | 12/2007 | Kroon | |
| 2008/0029110 | A1 | 2/2008 | Dube et al. | |
| 2008/0029116 | A1 | 2/2008 | Robinson et al. | |
| 2008/0142535 | A1 | 6/2008 | Adler et al. | |
| 2009/0200332 | A1 | 8/2009 | Intini | |
| 2009/0223989 | A1 | 9/2009 | Gelardi | |

FOREIGN PATENT DOCUMENTS

| | | | |
|---|---|---|---|
| GB | 2 042 476 | | 9/1980 |
| WO | WO 99/48391 | A | 9/1999 |
| WO | WO 2004/035404 | A1 | 4/2004 |
| WO | WO-2004/037657 | | 5/2004 |
| WO | WO 2005/016036 | A1 | 2/2005 |
| WO | WO 2005/028316 | A2 | 3/2005 |
| WO | WO 2005/030606 | A1 | 4/2005 |
| WO | WO 2005/035390 | A1 | 4/2005 |
| WO | WO 2007/017761 | A2 | 2/2007 |
| WO | WO 2007/067953 | A2 | 6/2007 |
| WO | WO 2007/070867 | A2 | 6/2007 |
| WO | WO 2008/070032 | A2 | 6/2008 |
| WO | WO 2009/055547 | A1 | 4/2009 |

* cited by examiner

DISPENSING CONTAINER

FIELD OF THE INVENTION

The present invention relates to containers and methods of use thereof. More particularly, the invention relates to containers that provide dispensing or dosing of the stored product.

BACKGROUND OF THE INVENTION

Various types of containers for dispensing solid objects, particularly solid products intended for human consumption, are known in the art. Such containers are often characterized by a hand-held size that can be easily stored and transported. Exemplary consumable products that are often packaged in such containers include pharmaceutical compositions, oral tobacco products, snacks, mints, gums, breath strips, candy, and the like.

Certain consumable products, such as pharmaceutical products, require containers having a certain level of child resistance. Traditionally, pills have been packaged in a bottle having a cap that can only be removed by applying downward pressure while twisting the cap. However, this type of child resistance has certain disadvantages. For example, if a child does manage to open the bottle, immediate access is provided to the entire contents of the bottle. Further, if an adult user fails to place the cap in the properly secured position, there is no secondary mechanism for preventing access by a child.

In addition to child resistance, another desirable feature for certain containers is the ability to dispense a metered amount of a product. In other words, it can be highly desirable for the container to control dispensing such that only a defined number of stored product units, such as only a single unit, is dispensed each time the container is opened. Metered distribution of a product can be advantageous as a further level of child resistance as it prevents unrestricted access to the entire contents of the container, and as a means to improve sanitation because such a container negates the need to touch numerous units within the container in order to obtain a single desired unit.

Exemplary containers that provide a locking mechanism for enhancing child-resistance of a container can be found, for example, in U.S. Pat. No. 6,863,175 to Gelardi; U.S. Pat. No. 6,913,149 to Gelardi et al.; U.S. Pat. No. 6,976,576 to Intini; and U.S. Pat. No. 7,216,776 to Gelardi, which are incorporated herein by reference in their entirety.

There remains a need in the art for a container for storing and dispensing a product capable of combining various advantageous features, such as child resistance, metered dispensing, and convenient size.

BRIEF SUMMARY OF THE INVENTION

The present invention provides a container that, in certain embodiments, combines child-resistance with metered dispensing, and which can be provided in a convenient handheld size. The type and form of the product to be stored and dispensed can vary, but rod-shaped and pellet-shaped products are particularly well-suited for use with the containers of the invention.

In one embodiment, the container of the invention comprises a storage compartment configured to store a plurality of units of a product to be dispensed, the storage compartment extending longitudinally within a plane. The container further includes a dispensing chamber for receiving at least one unit of the product, the dispensing chamber configured for movement between a closed and locked position and a dispensing position. A dispensing pathway is provided between the storage compartment and the dispensing chamber, the dispensing pathway preferably sized for passage of at least one unit of the product. A locking mechanism adapted for releasably locking the dispensing chamber in the closed and locked position is also provided, as well as a blocking member operatively positioned to block the dispensing pathway when the dispensing chamber is in the dispensing position. Typically, the dispensing chamber pivots laterally between the closed and locked position and the dispensing position such that the axis of rotation of the dispensing chamber is substantially perpendicular the longitudinal plane of the storage compartment.

The locking mechanism typically comprises a button that is depressed to release the dispensing chamber from the closed and locked position. The blocking member can comprise one or more ridges adjacent to the dispensing chamber and operatively positioned to block the dispensing pathway when the dispensing chamber is in the dispensing position.

In another embodiment, the container of the invention comprises a main body portion defining a storage compartment configured to store a plurality of units of a product to be dispensed, the storage compartment extending longitudinally within a plane, the main body portion comprising an outwardly-extending, resilient locking button; and a dispensing tray pivotally engaged with the main body portion and comprising a dispensing chamber in communication through a dispensing pathway with the storage compartment of the main body portion. The dispensing tray can be configured to pivot, around an axis of rotation substantially perpendicular to the longitudinal plane of the storage compartment, between a closed and locked position wherein the dispensing chamber is inaccessible from the exterior of the container and a dispensing position wherein the dispensing chamber is accessible from the exterior of the container.

The dispensing tray can further comprise an aperture through which the locking button of the main body portion extends when the dispensing tray is in the closed and locked position such that the locking button is accessible from the exterior of the container.

In another embodiment, the locking button comprises a recess facing the dispensing tray and the dispensing tray comprises a moveable flap and an adjacent projection, the flap operatively positioned to engage the locking button when the dispensing tray is in the closed and locked position and the projection operatively positioned to engage the recess when the dispensing tray is in the closed and locked position, such that depressing the flap will depress the locking button and disengage the projection from the recess of the locking button.

The dispensing tray can further comprise a button chamber adapted for housing the locking button when the dispensing tray is in the dispensing position. Thus, the locking button is configured for movement between two positions, a locked position wherein the locking button extends through the aperture of the dispensing tray and an unlocked position wherein the locking button is depressed and positioned within the button chamber in the dispensing tray.

In a further embodiment, the dispensing tray carries a tab that engages the main body portion and guides the pivoting action of the dispensing tray. For example, the dispensing chamber defined by the dispensing tray can be open at one end, and the main body portion can further comprise an outwardly-projecting lip that covers the open end of the dispensing chamber when the dispensing tray is in the closed and locked position. The dispensing tray may further include a tab operatively positioned to slidingly engage a slot in the outwardly-projecting lip as the dispensing tray pivots between the closed and locked position and the dispensing position.

In a still further embodiment, the invention provides a container comprising:

a cover plate;

a middle plate fixedly attached to the cover plate and having a first surface facing the cover plate and an opposing surface facing away from the cover plate, the cover plate and the middle plate defining a storage compartment configured to store a plurality of units of a product to be dispensed, the storage compartment extending longitudinally within a plane, the middle plate comprising an aperture in communication with the storage compartment and sized for passage of at least one unit of the product, an outwardly-extending locking button projecting from the opposing surface and configured for movement between a locked position and an unlocked position and being resiliently urged into the locked position, and an outwardly-extending lip projecting from the opposing surface; and a dispensing tray pivotally engaged with the middle plate and comprising an open-ended dispensing chamber in communication with the aperture of the middle plate.

The dispensing tray is configured to pivot, around an axis of rotation substantially perpendicular to the longitudinal plane of the storage compartment, between a closed and locked position wherein the dispensing chamber is inaccessible from the exterior of the container and a dispensing position wherein the open end of the dispensing chamber is accessible from the exterior of the container. The outwardly-extending lip of the middle plate covers the open end of the dispensing chamber when the dispensing tray is in the closed and locked position.

The dispensing tray can further comprise an aperture through which the locking button of the middle plate is urged when the dispensing tray is in the closed and locked position such that the locking button is accessible from the exterior of the container, and one or more ridges positioned adjacent to the dispensing chamber such that the one or more ridges prevent movement of a unit of the product through the aperture of the middle plate when the dispensing tray is in the dispensing position.

In another aspect, the invention provides a method of dispensing at least one unit of a product from a container, the method comprising the steps of:

providing a container comprising a main body portion defining a storage compartment containing a plurality of units of a product to be dispensed, the storage compartment extending longitudinally within a plane, the main body portion comprising an outwardly-extending, resilient locking button; and a dispensing tray pivotally engaged with the main body portion and comprising a dispensing chamber in communication through a dispensing pathway with the storage compartment of the main body portion;

guiding at least one unit of the product into the dispensing chamber of the dispensing tray while the dispensing tray is in a closed and locked position such that the dispensing chamber is inaccessible from the exterior of the container;

depressing the locking button;

while maintaining the locking button in the depressed state, laterally pivoting the dispensing tray into a dispensing position such that the dispensing chamber is accessible from the exterior of the container, wherein the axis of rotation of the dispensing tray is substantially perpendicular to the longitudinal plane of the storage compartment; and removing a unit of the product from the dispensing chamber.

In one embodiment of the method, the container further comprises an aperture in the dispensing tray through which the locking button of the main body portion extends and through which the locking button is accessible from the exterior of the container, and the depressing step comprises depressing the locking button into the aperture of the dispensing tray through which the locking button extends.

In another embodiment of the method, the locking button comprises a recess facing the dispensing tray and the dispensing tray comprises a moveable flap and an adjacent projection, the flap operatively positioned to engage the locking button when the dispensing tray is in the closed and locked position and the projection operatively positioned to engage the recess when the dispensing tray is in the closed and locked position. In this embodiment, the depressing step comprises depressing the flap in order to depress the locking button such that the projection is disengaged from the recess of the locking button.

The method can further include the step of pivoting the dispensing tray back into the closed and locked position such that the locking button again extends through the aperture in the dispensing portion.

BRIEF DESCRIPTION OF THE DRAWINGS

Figure 1:
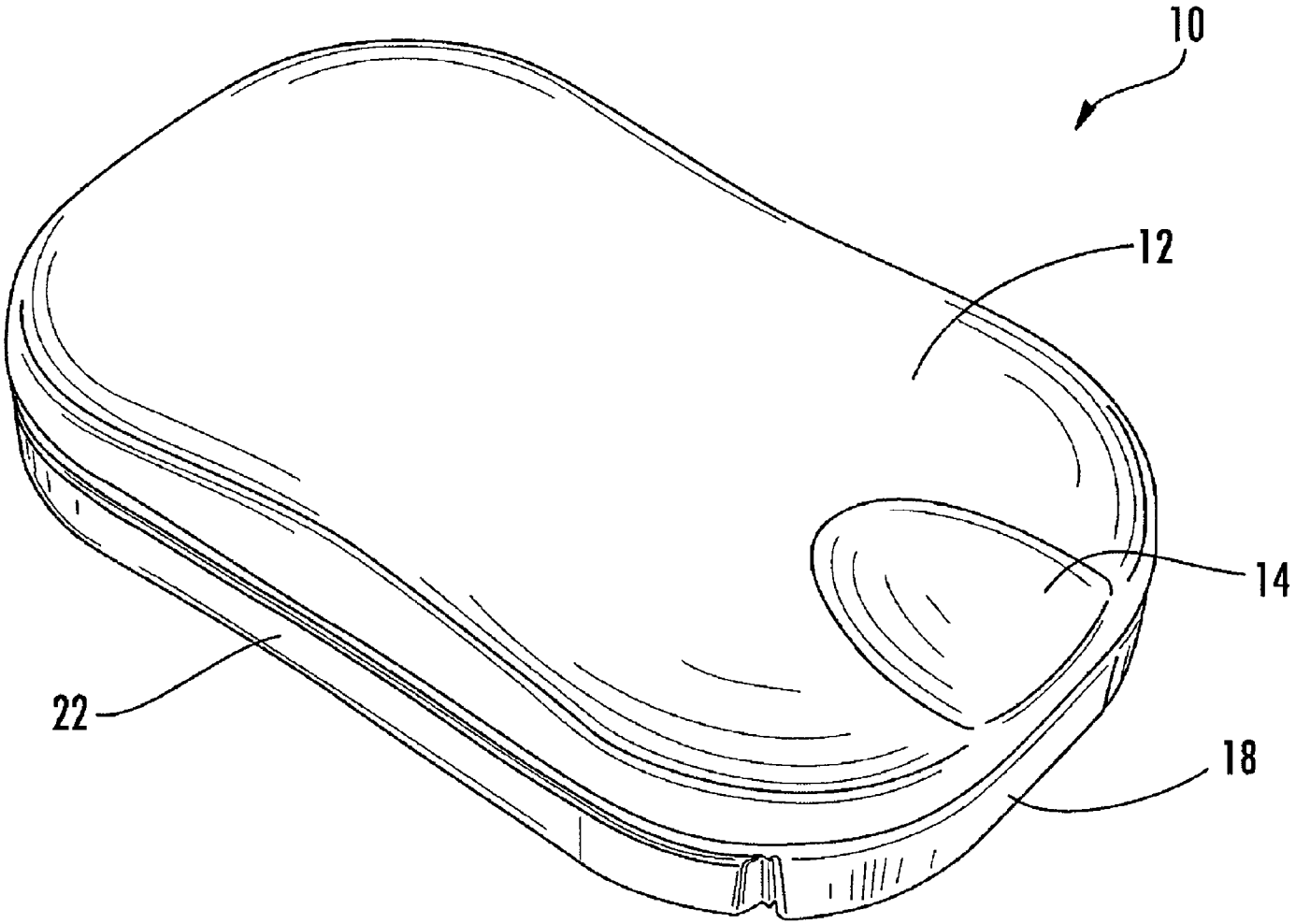
Figure 2:
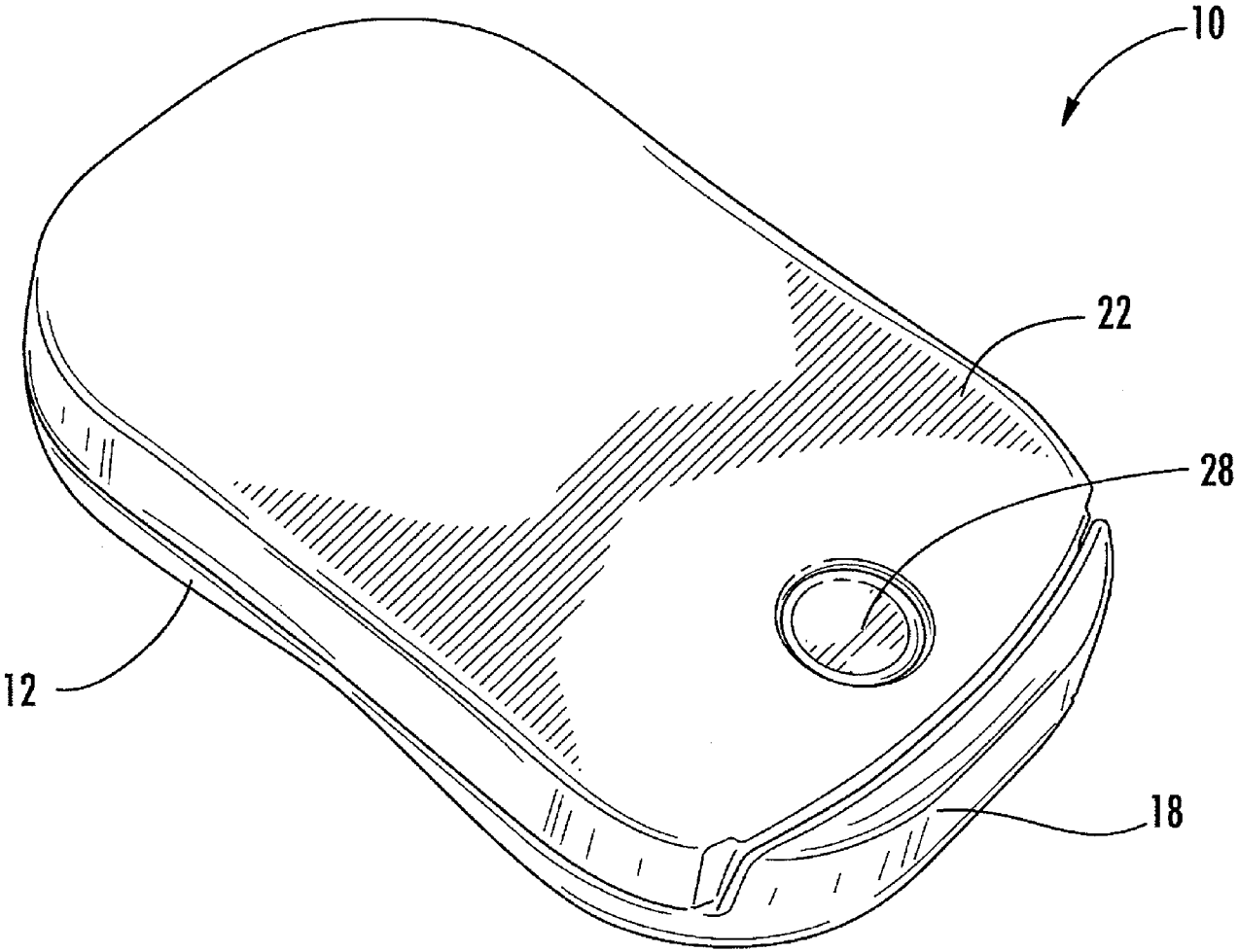
Figure 3:
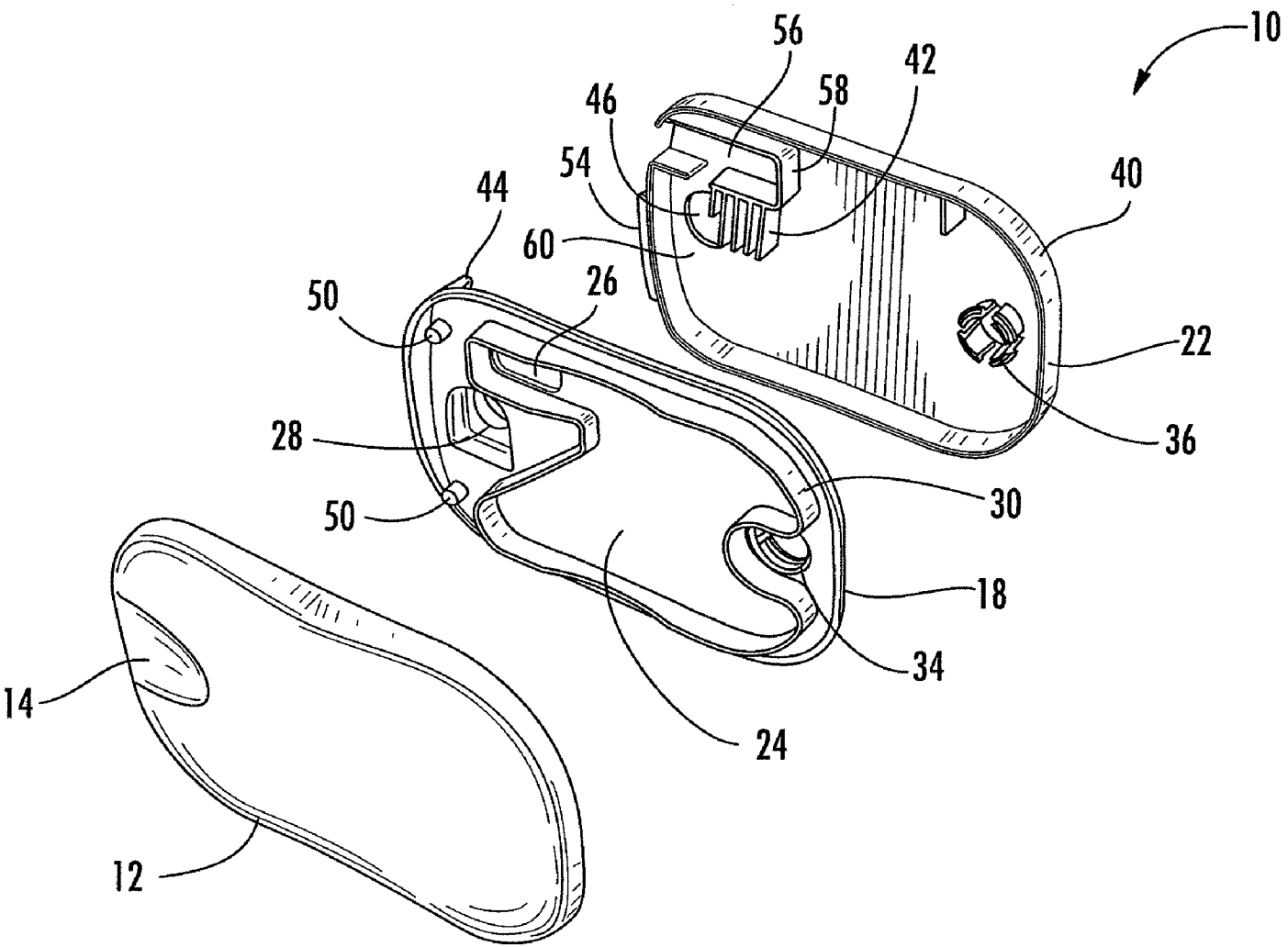
Figure 4:
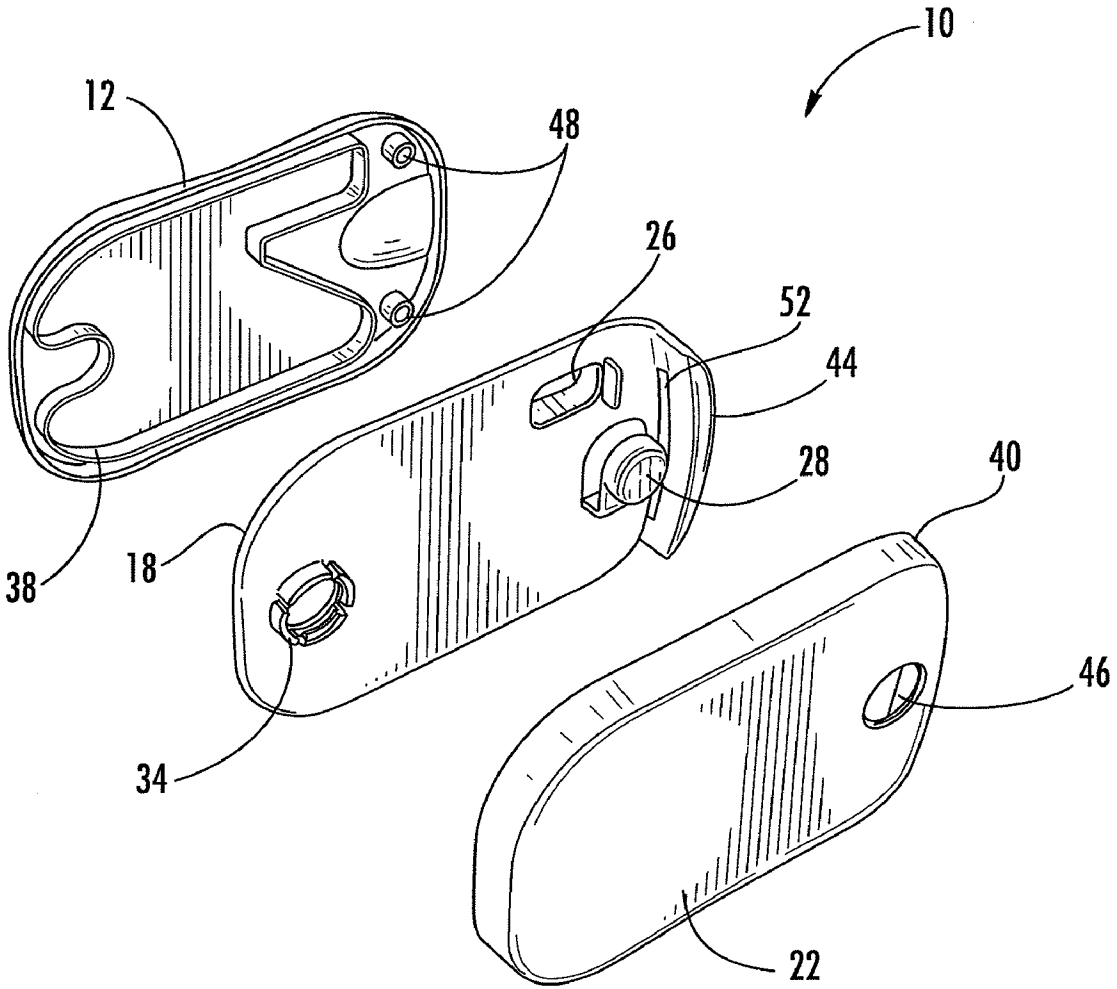
Figure 5:
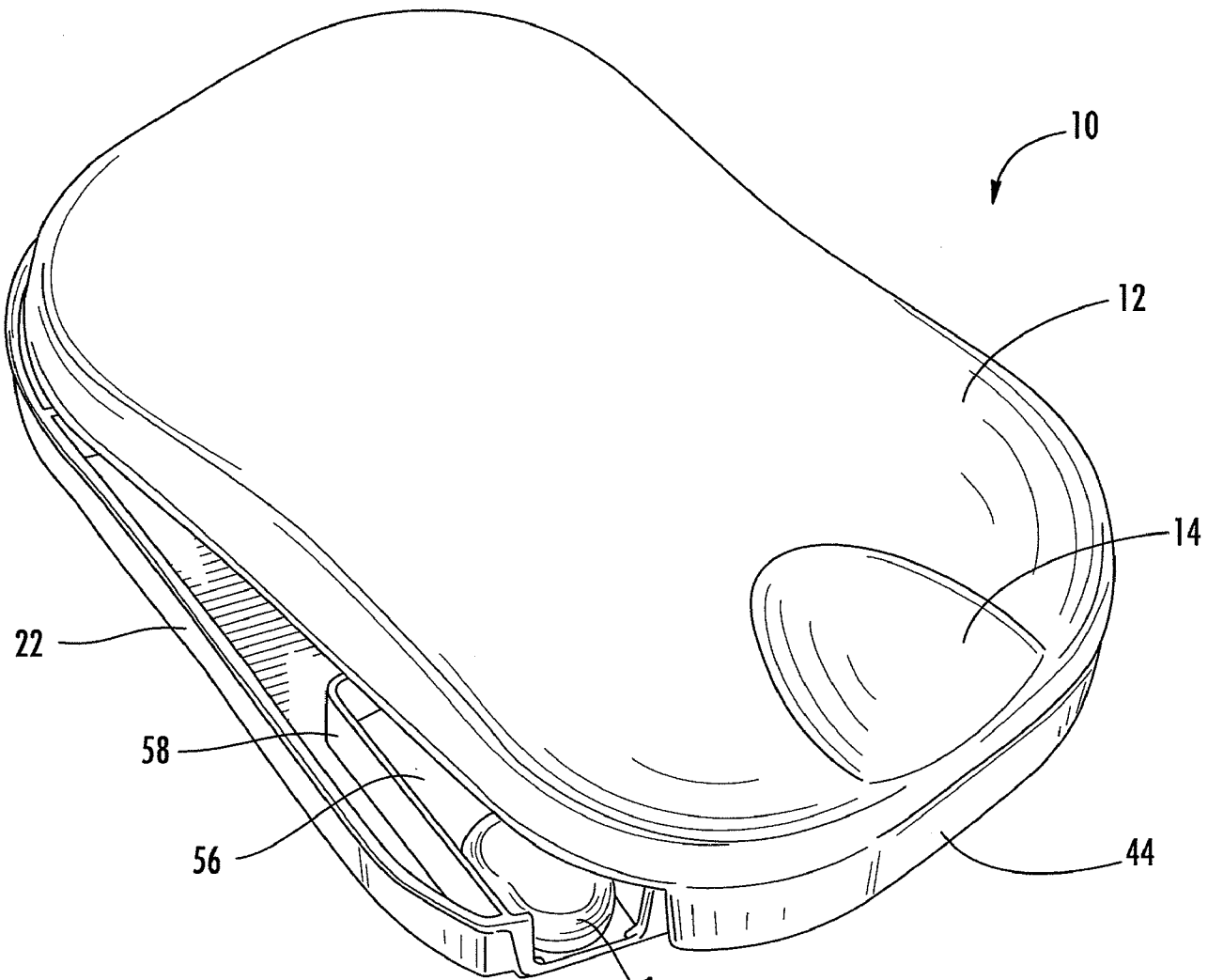
Figure 6:
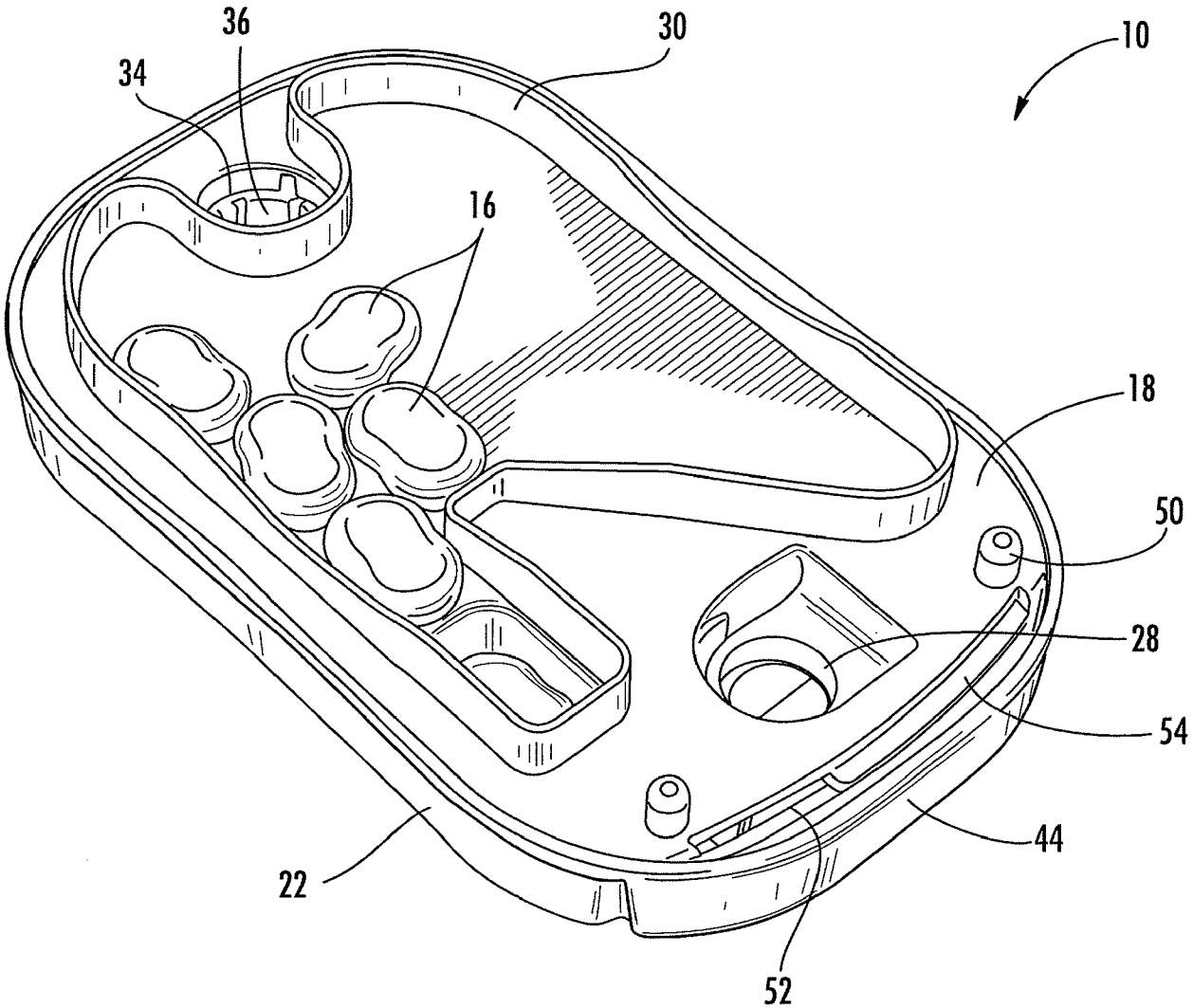
Figure 7:
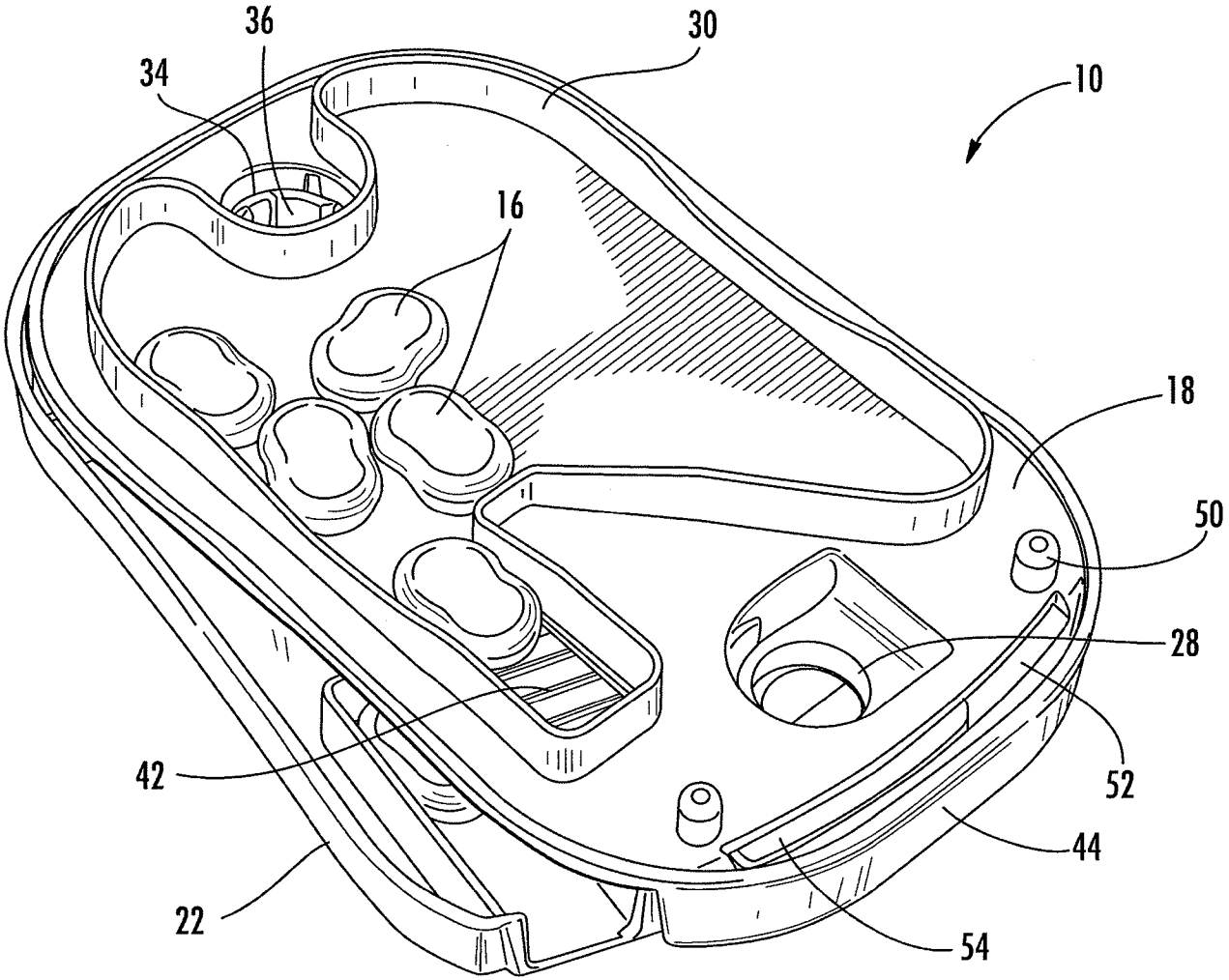
Figure 8:
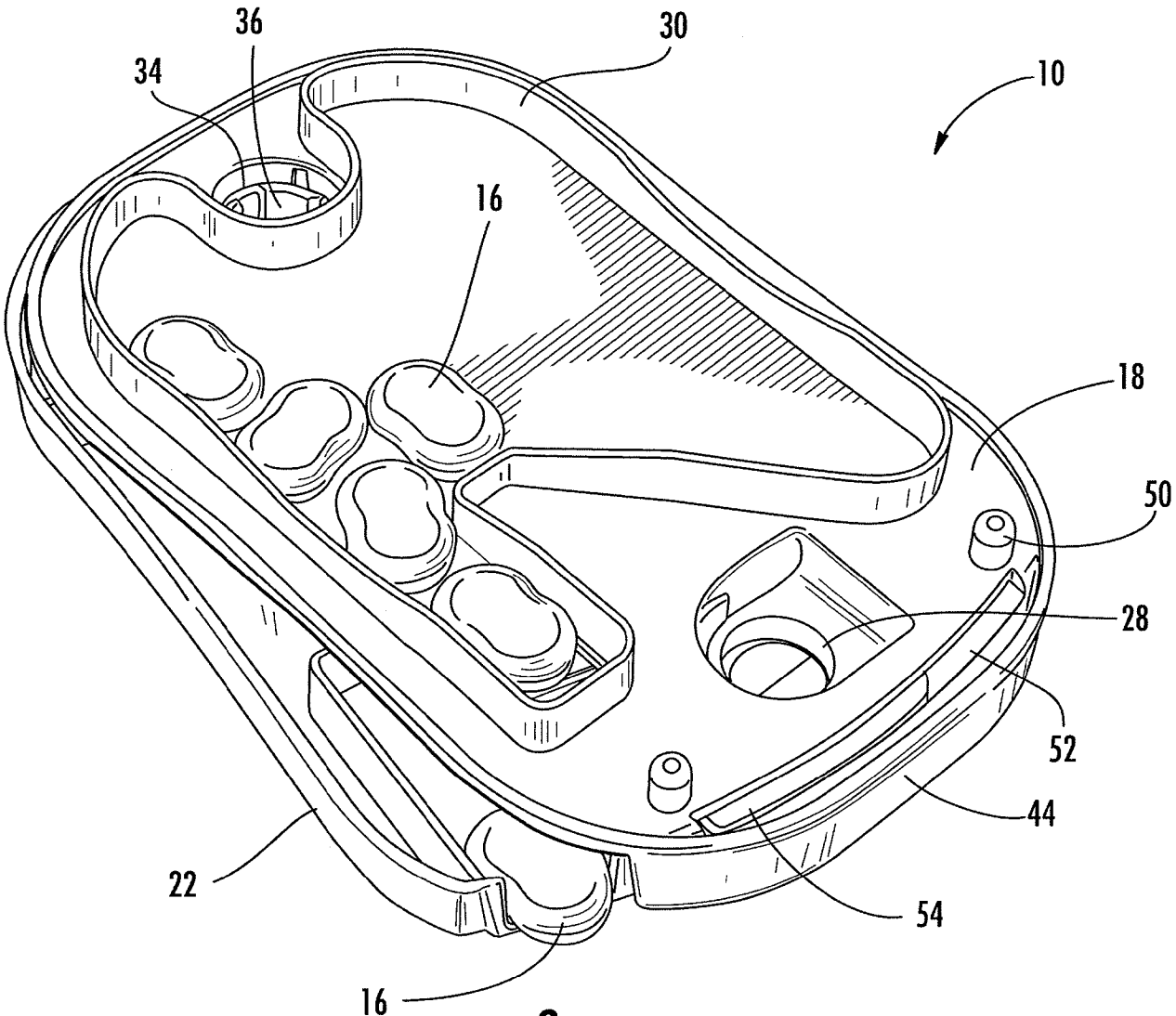
Figure 9:
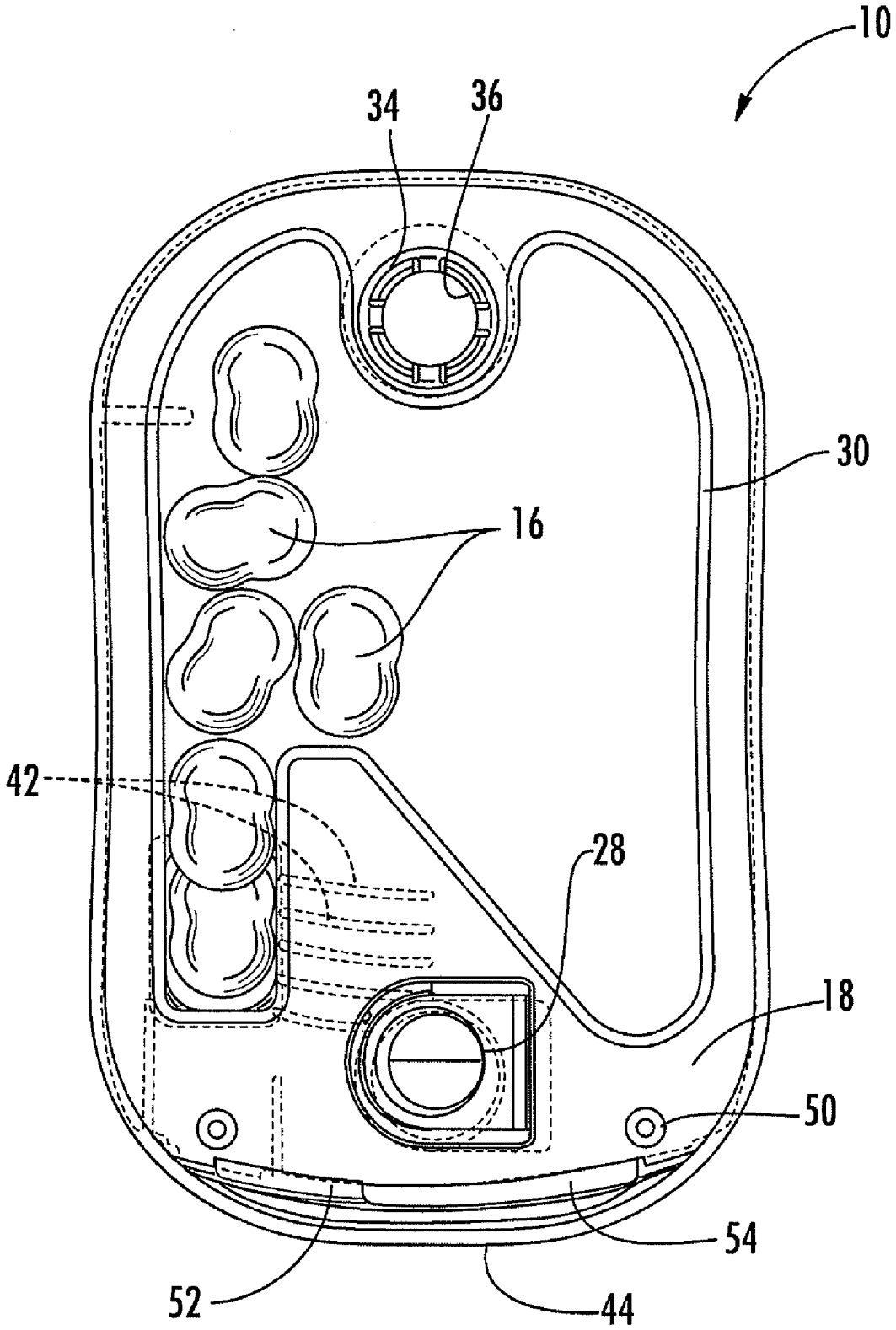
Figure 10:
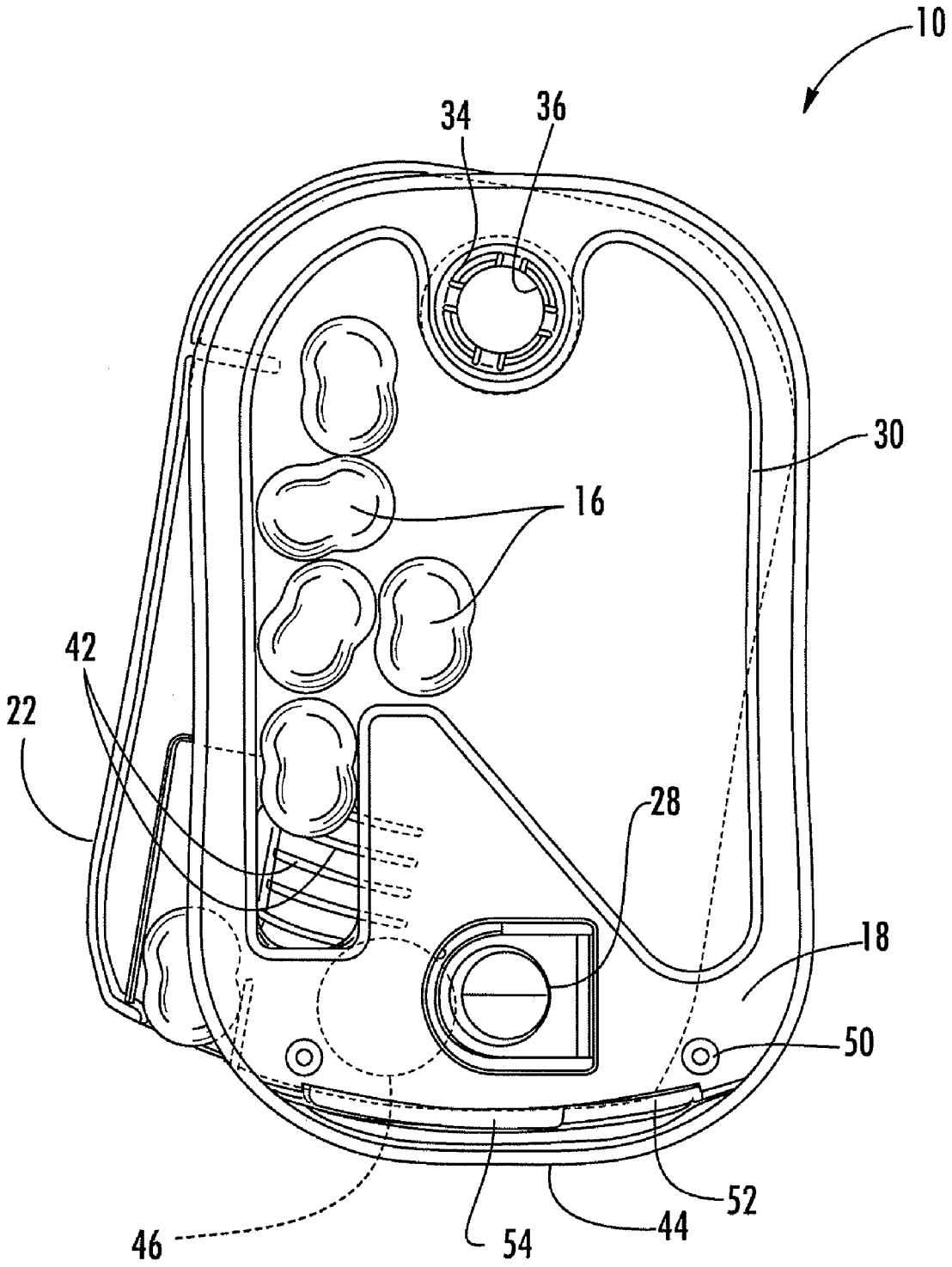
Figure 11:
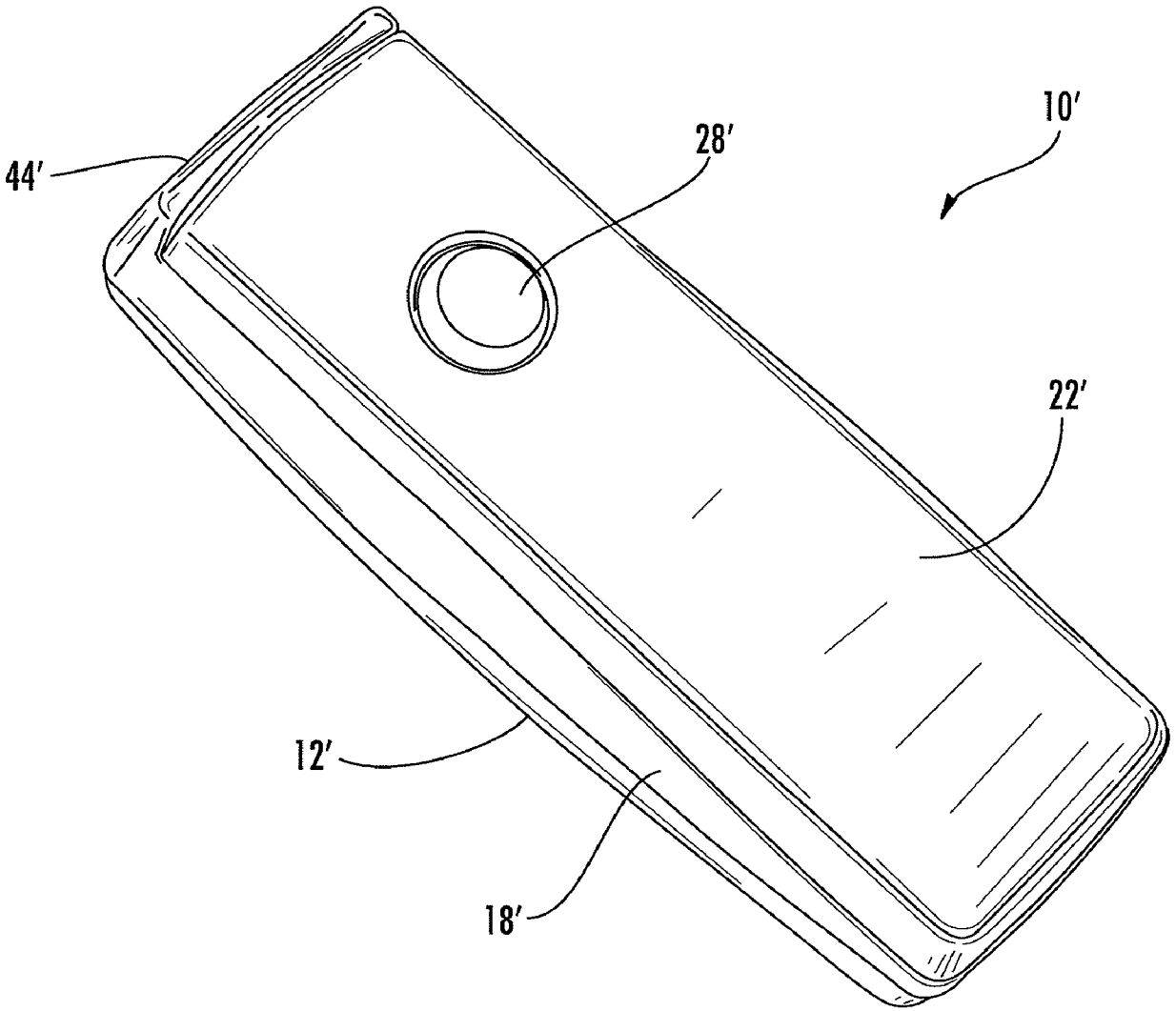
Figure 12:
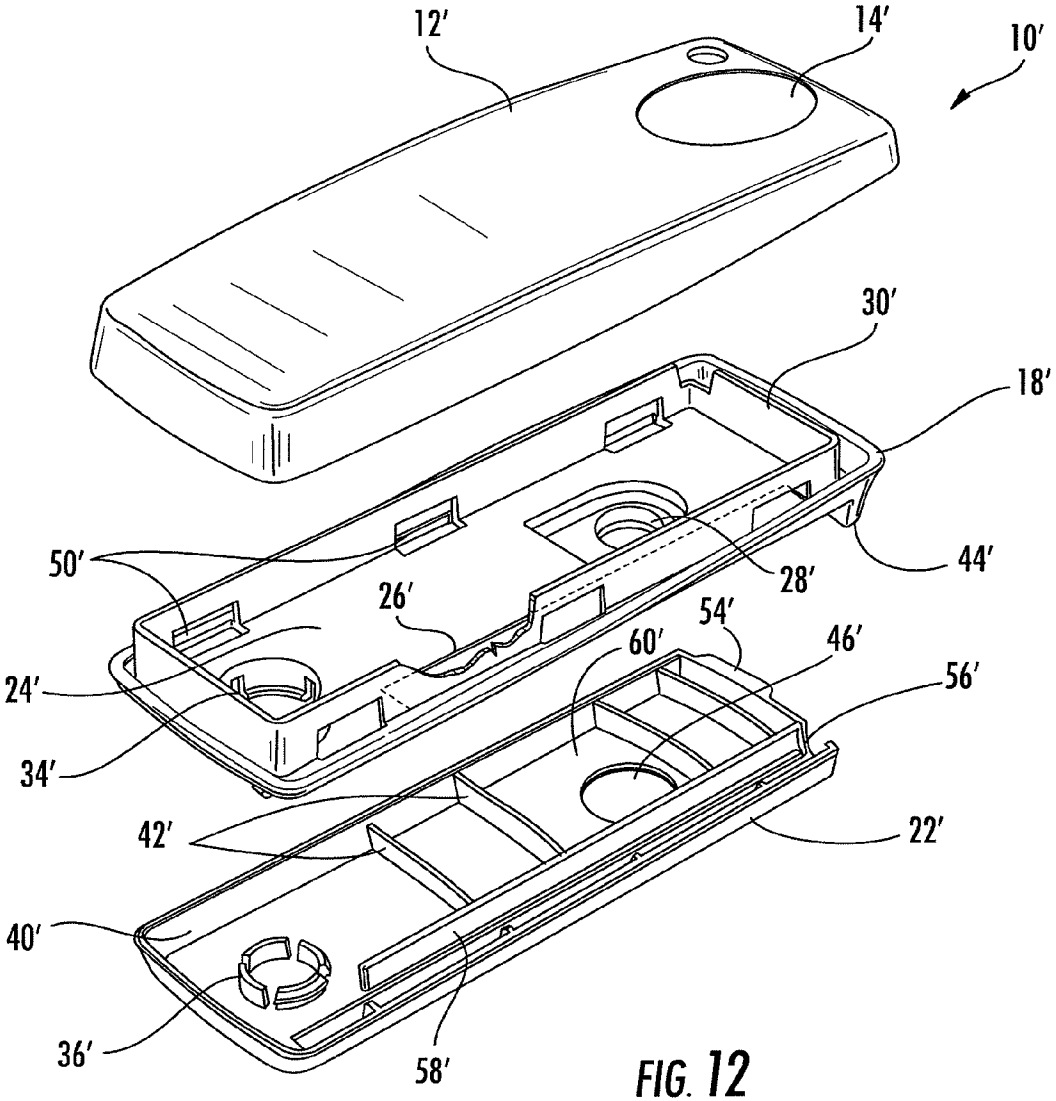
Figure 13:
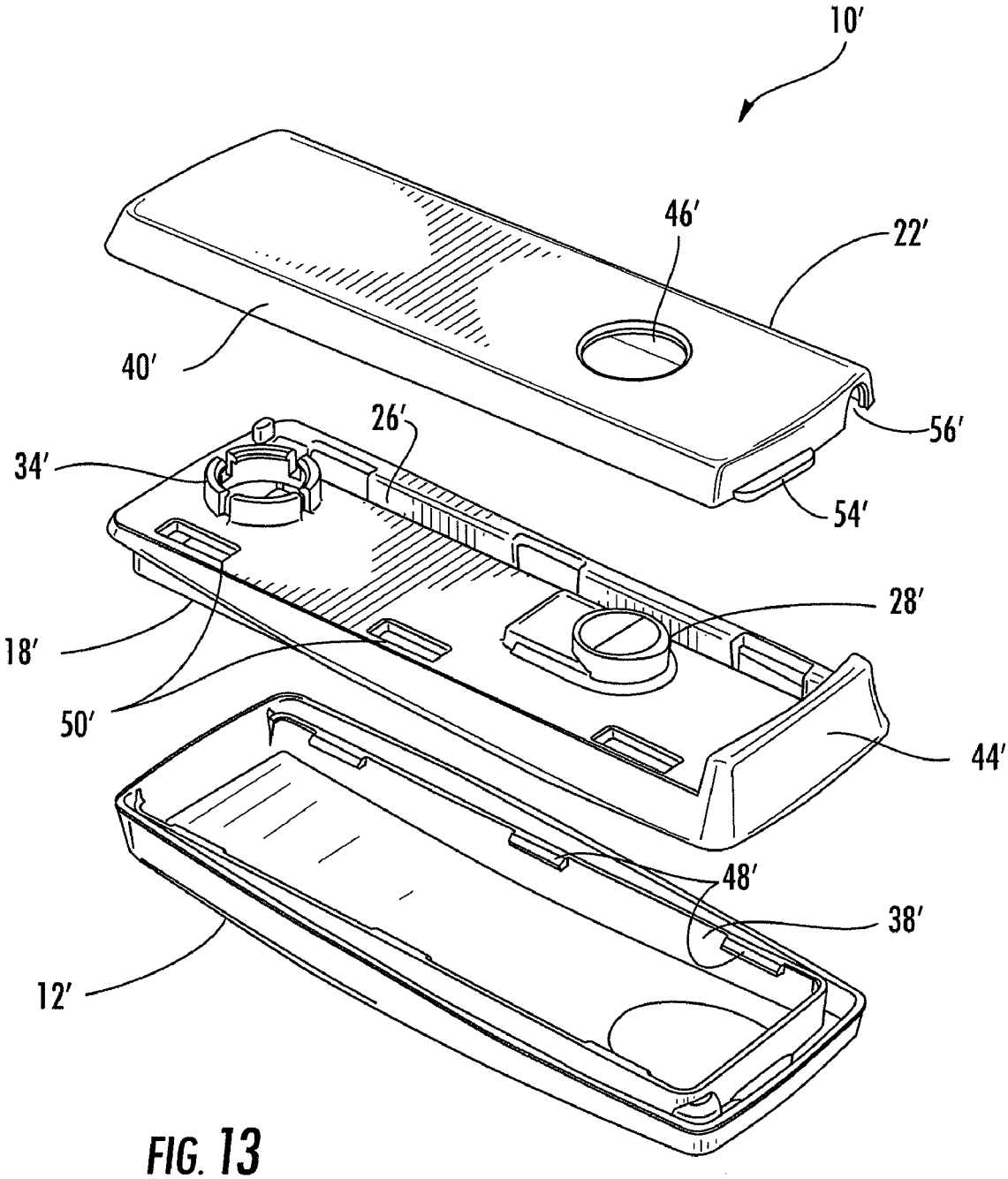
Figure 14:
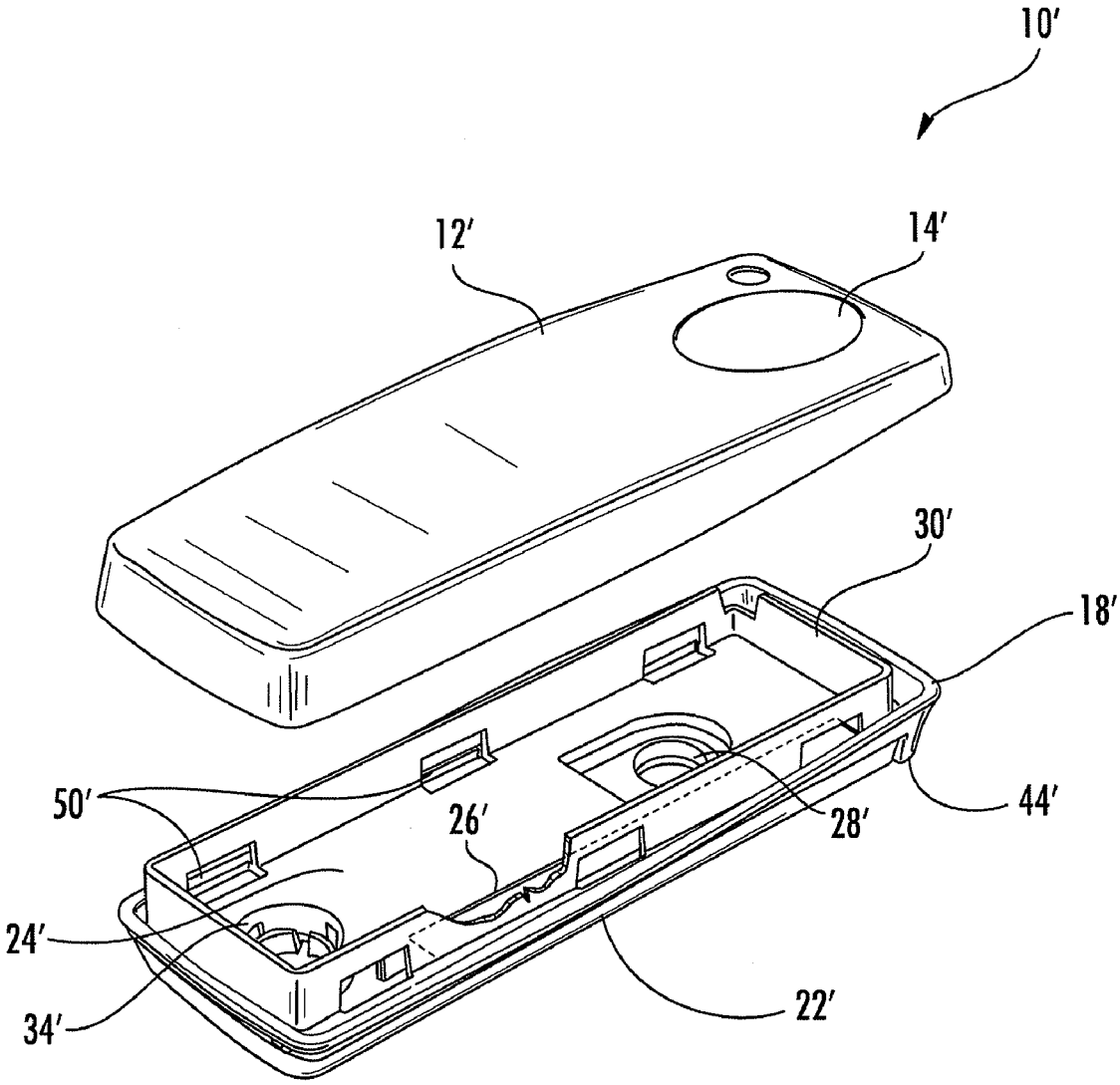
Figure 15:
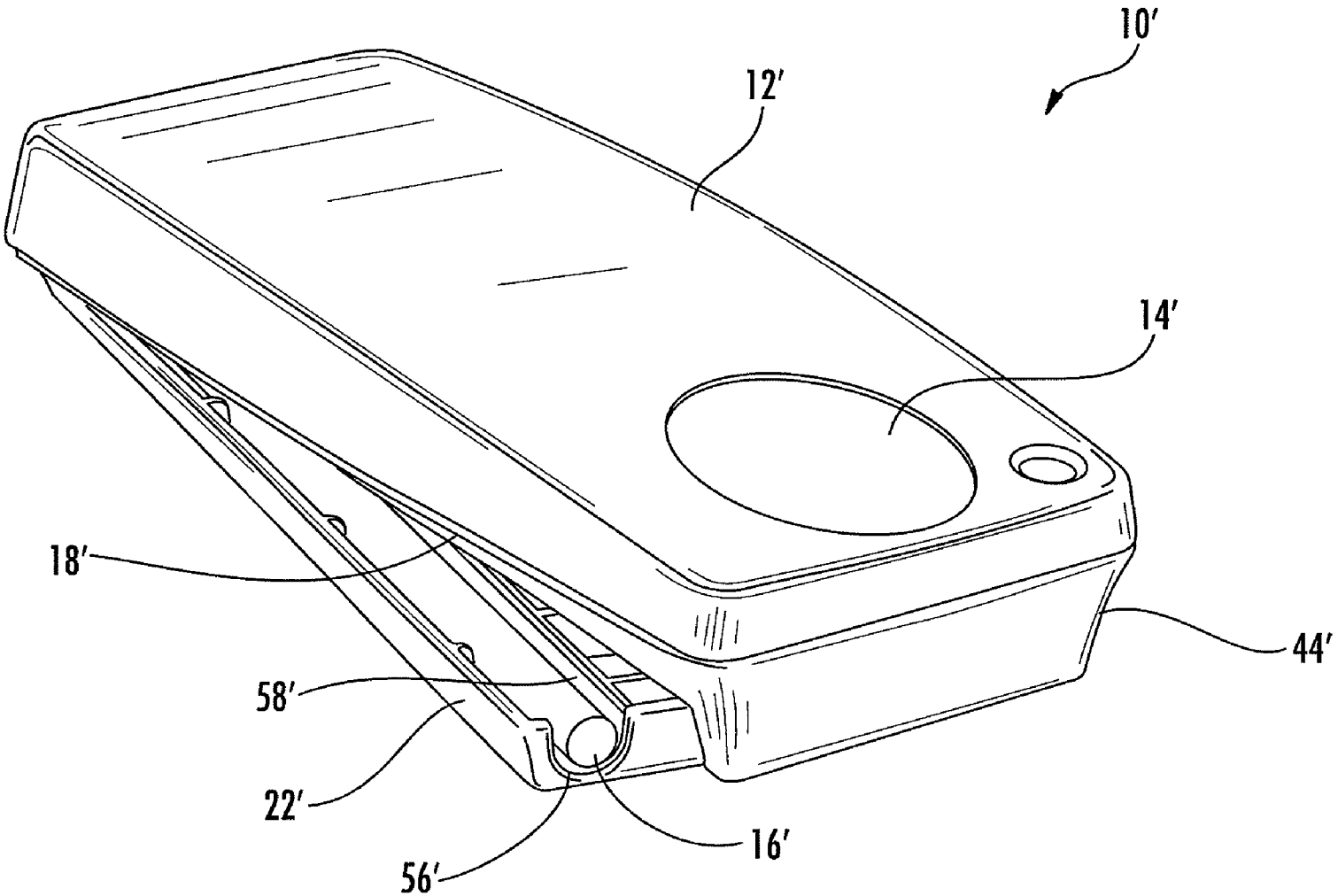
Figure 16:
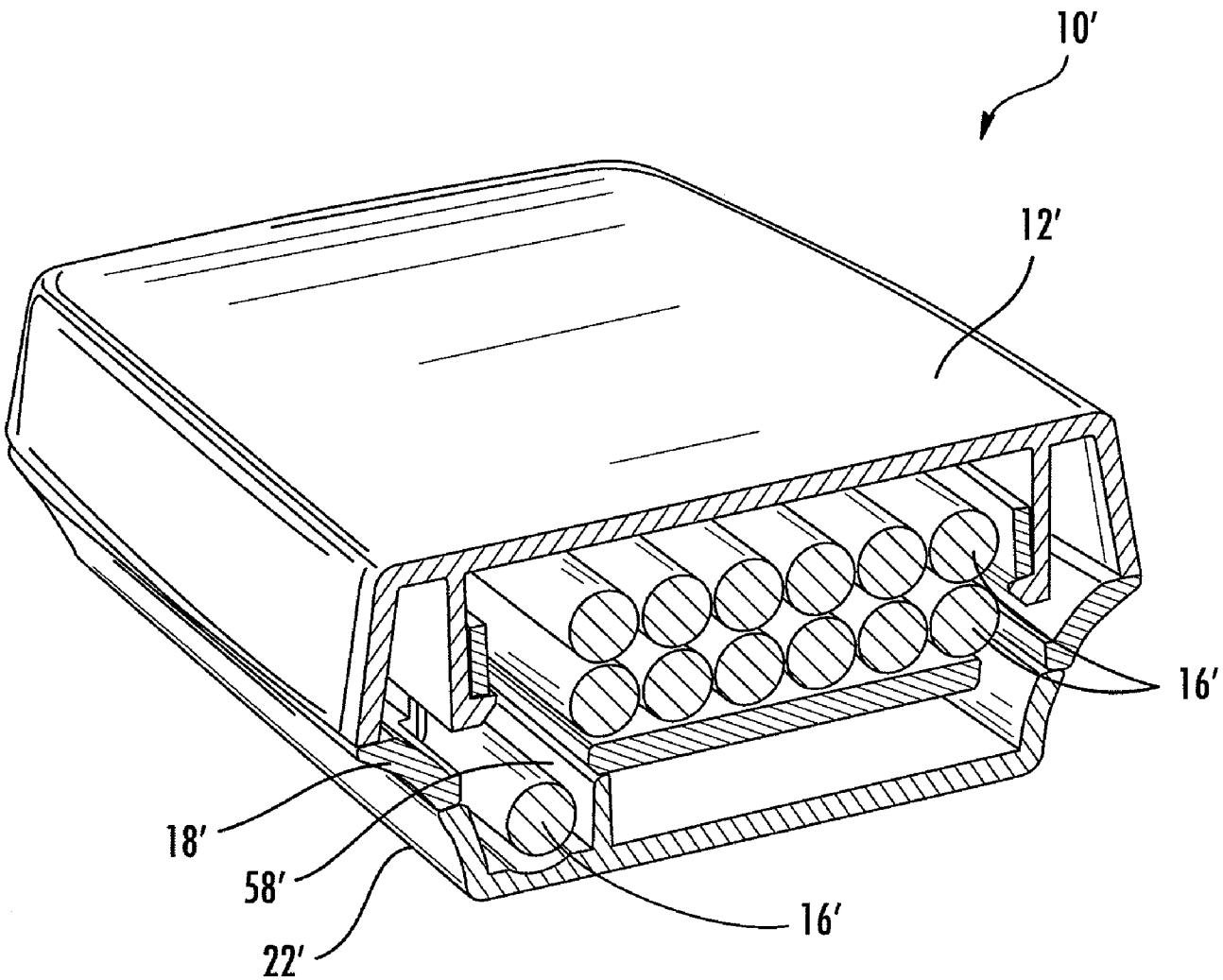
Figure 17:
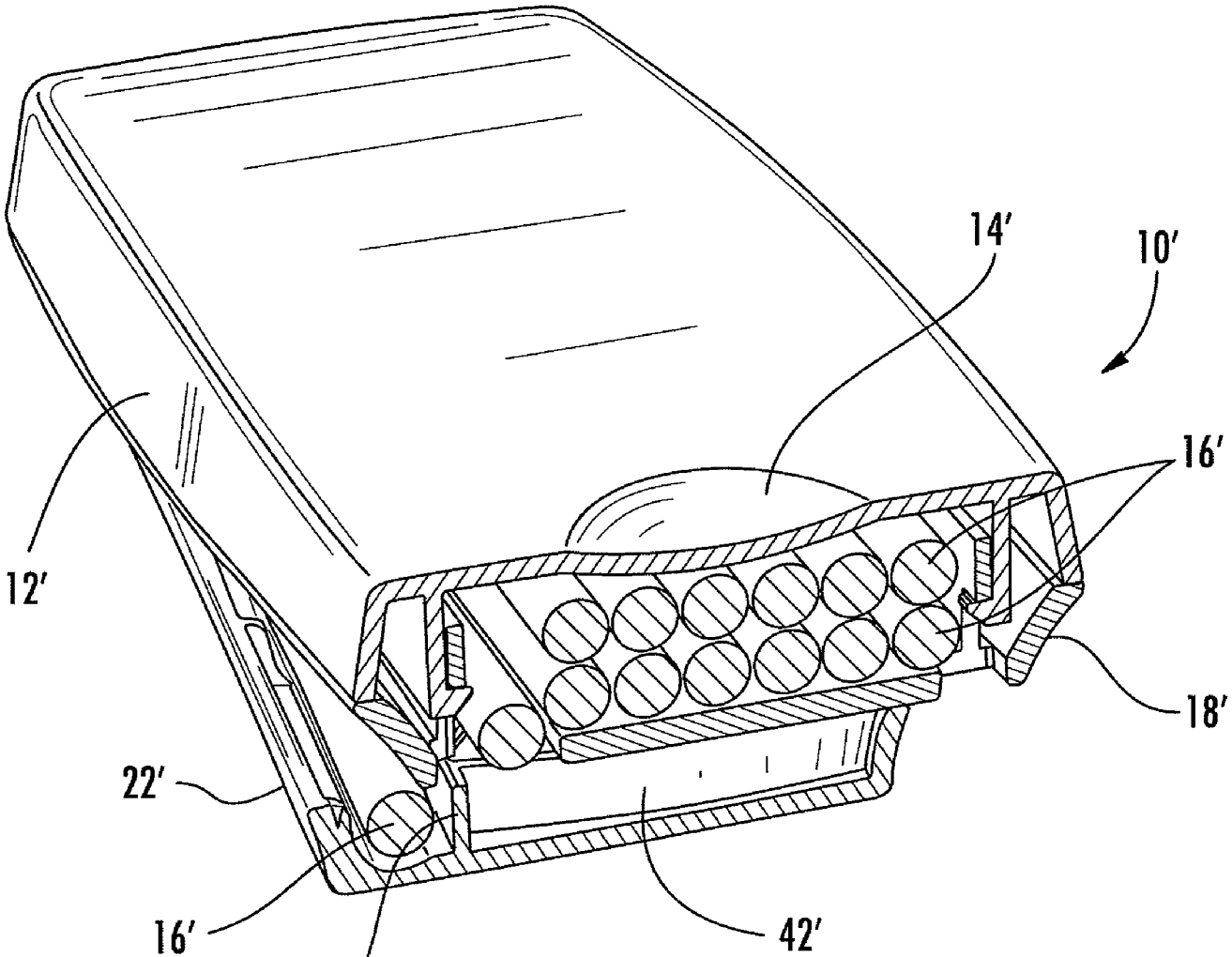
Figure 18:
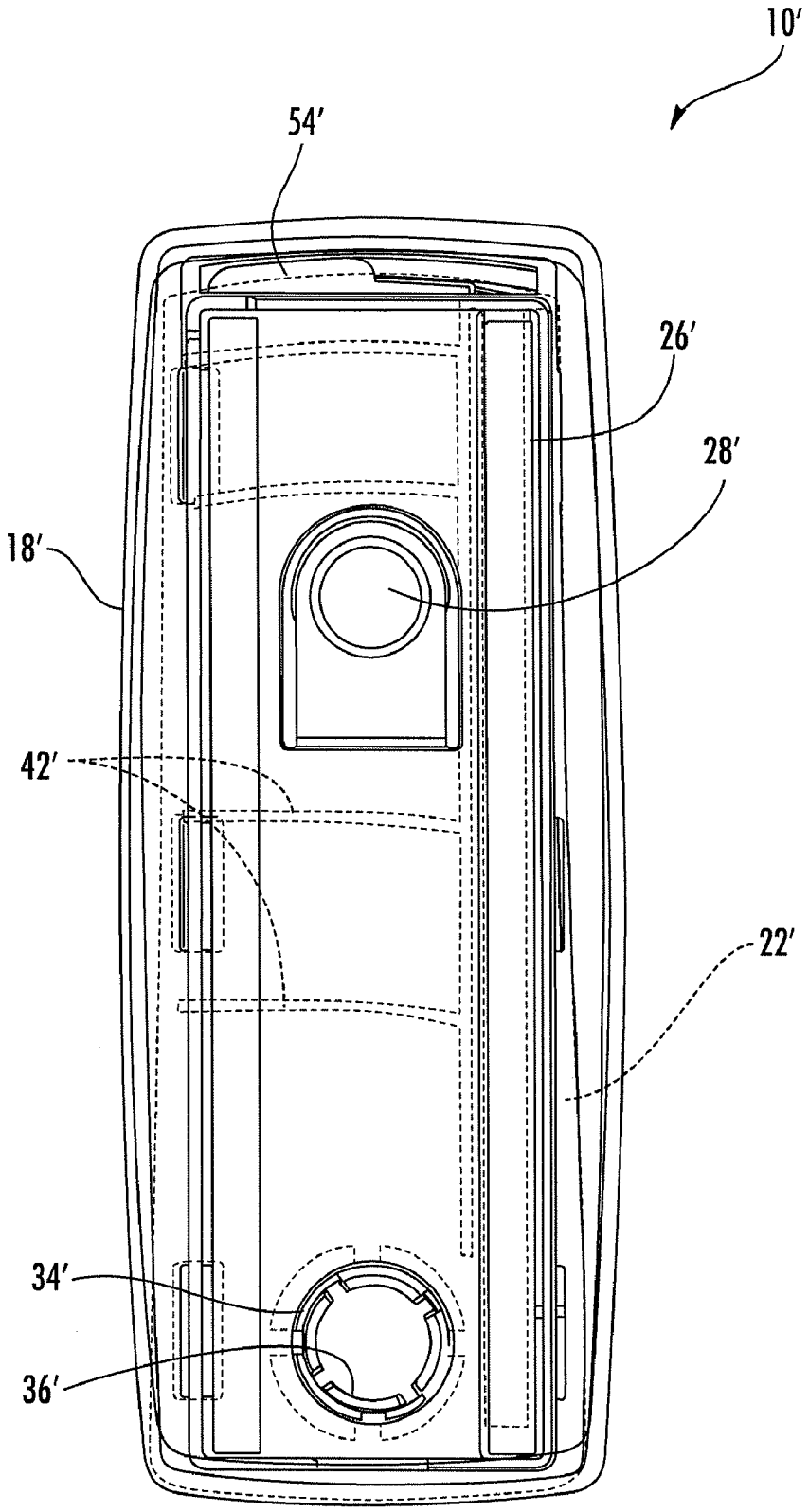
Figure 19:
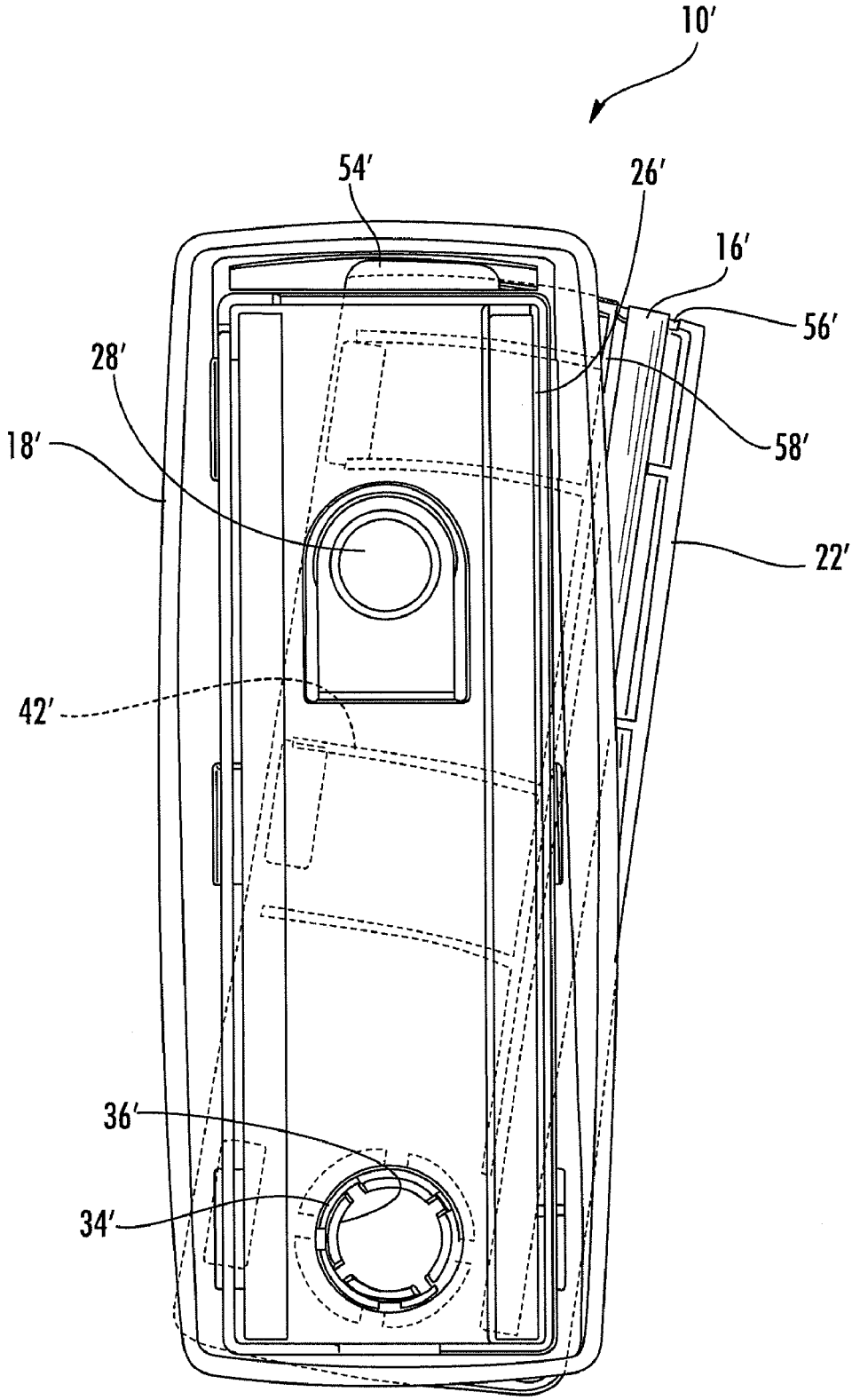
Figure 20:
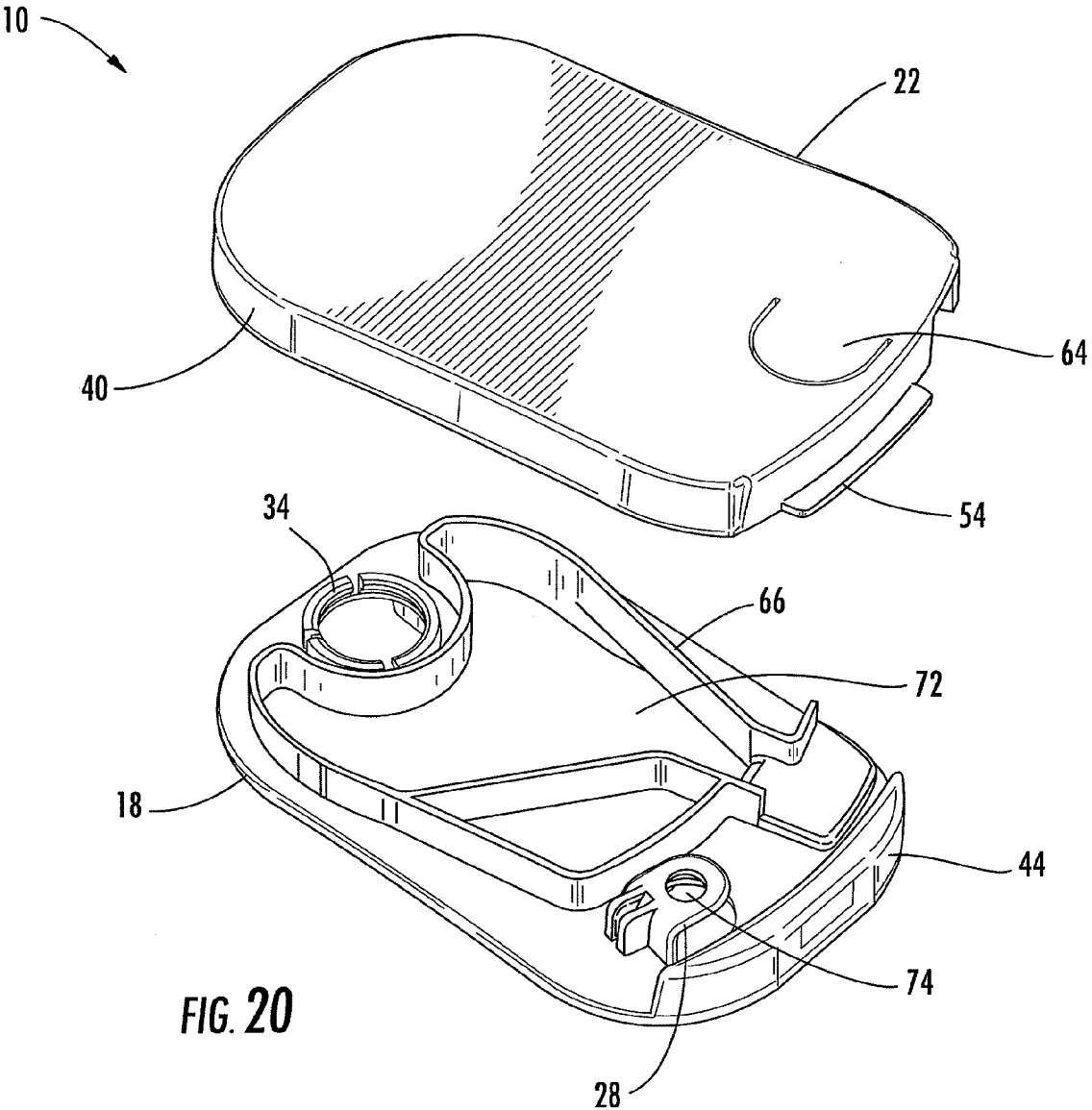
Figure 21:
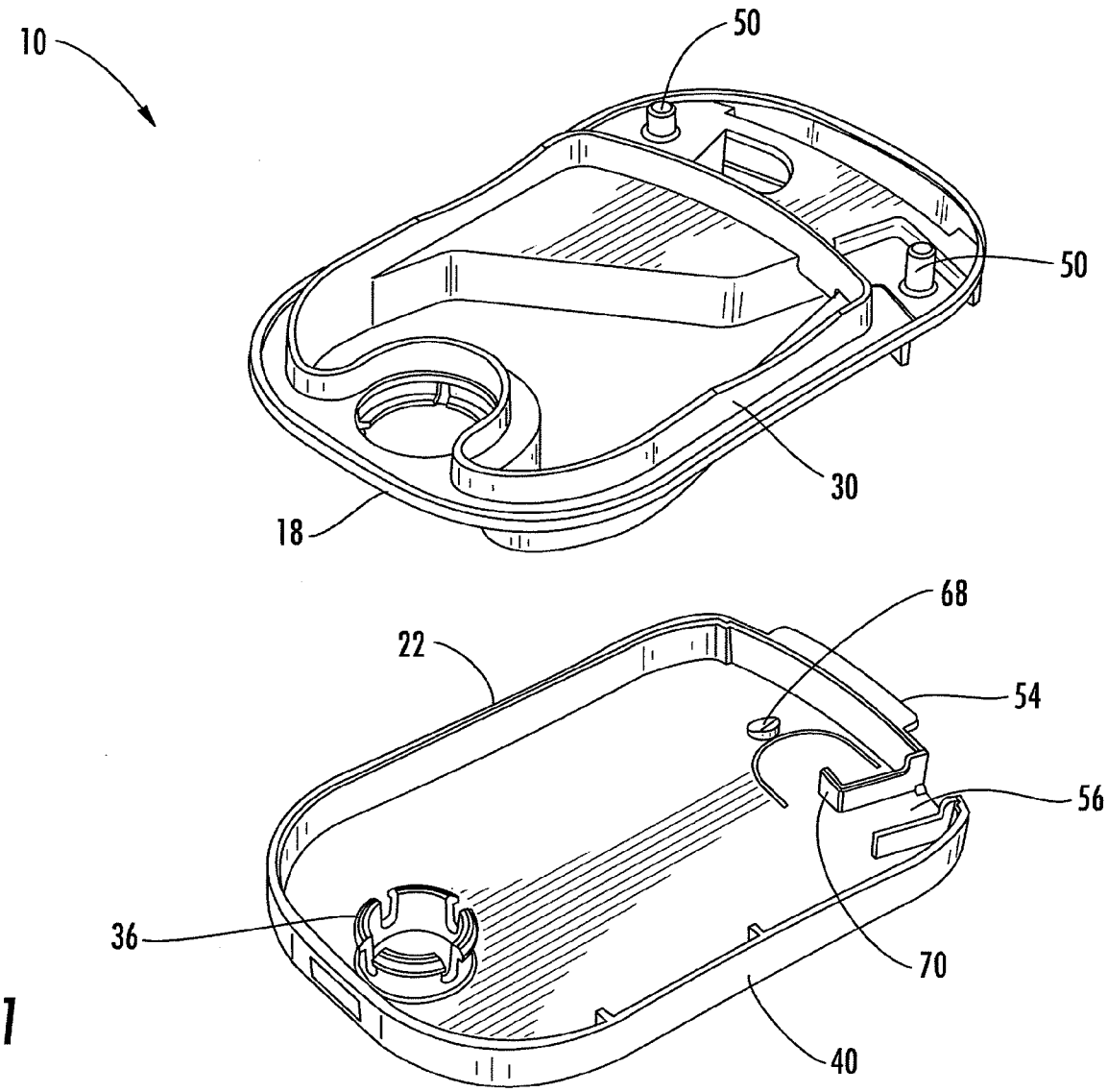
Figure 22:
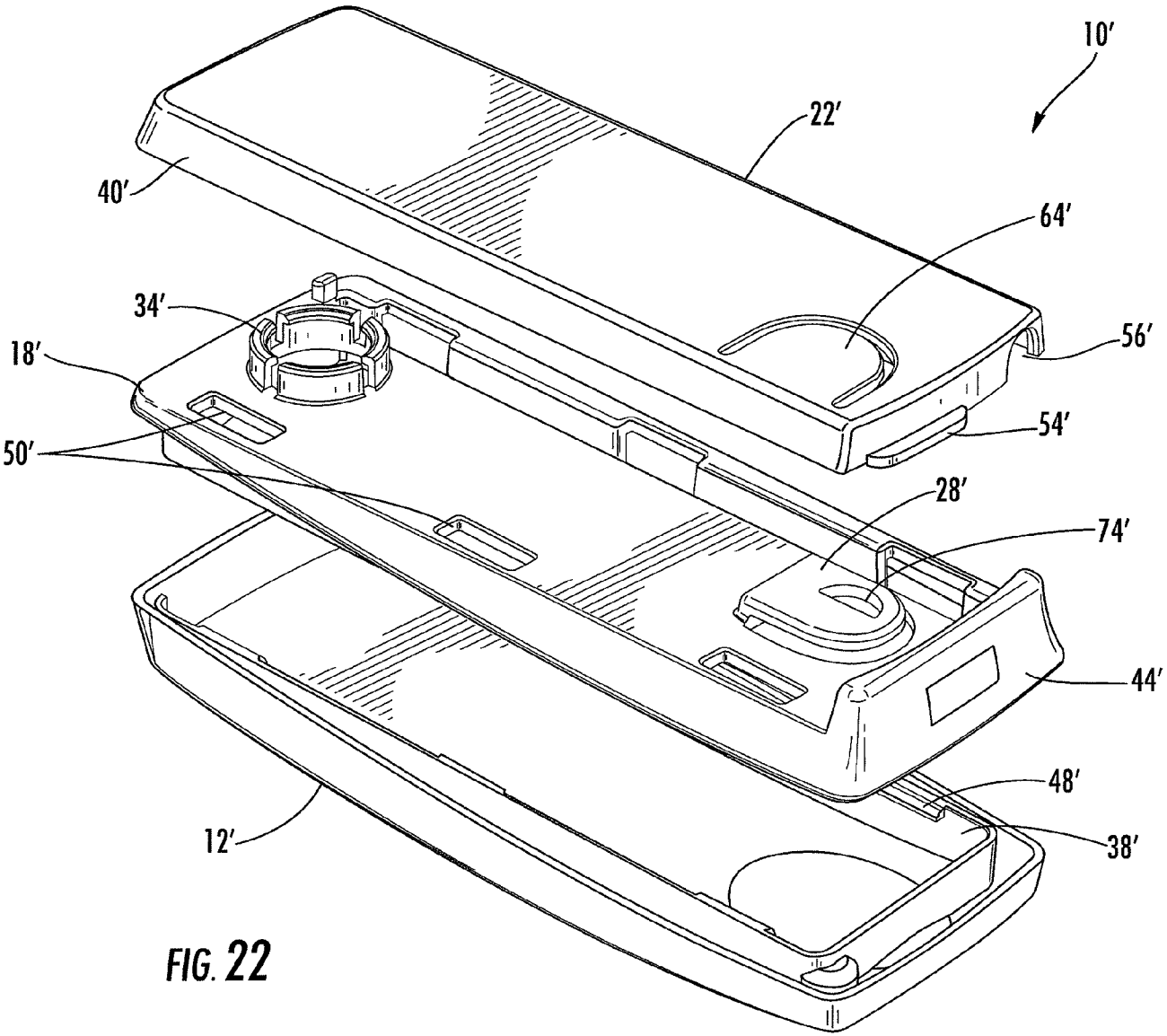
Figure 23:
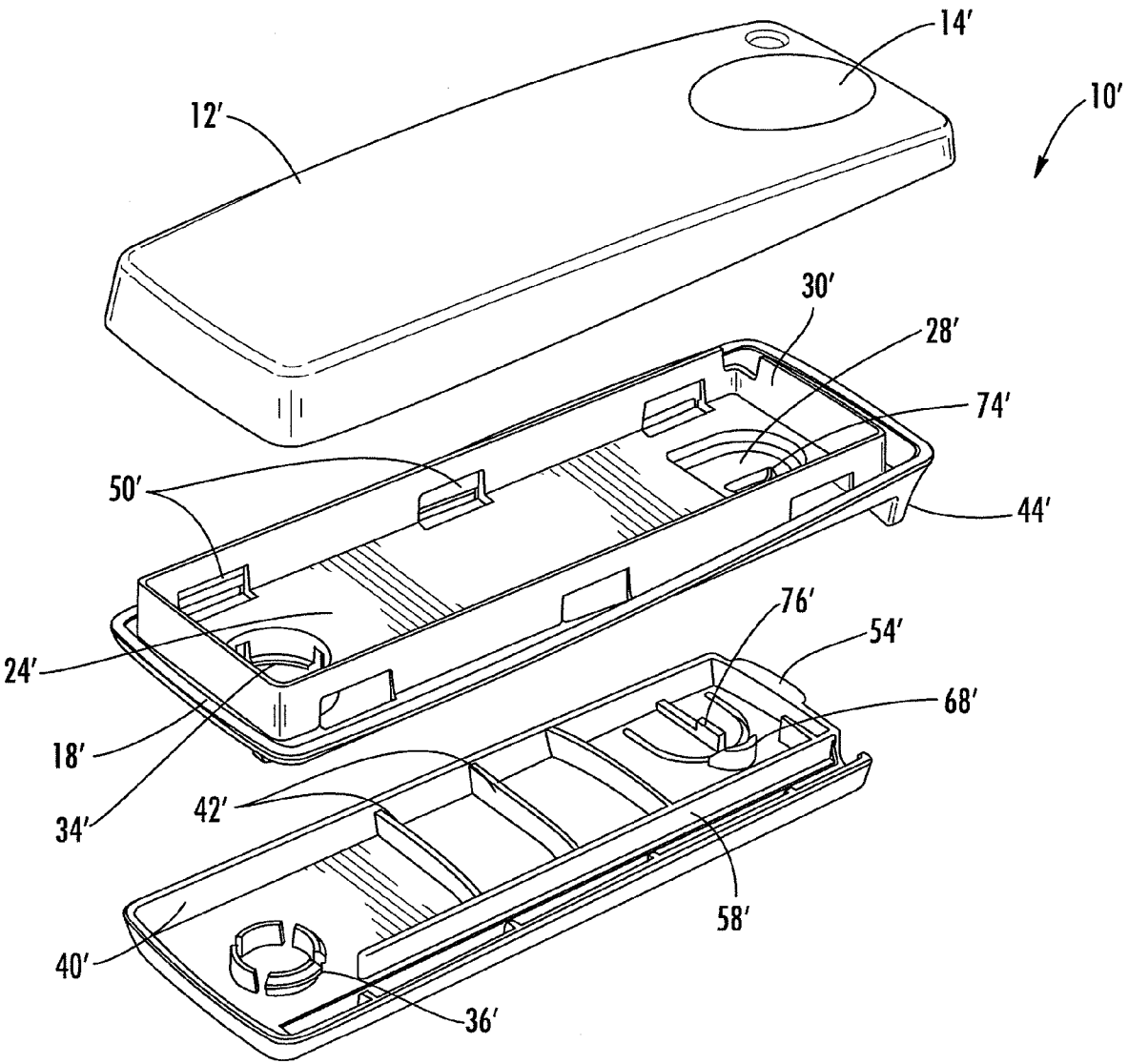

Having thus described the invention in general terms, reference will now be made to the accompanying drawings, which are not necessarily drawn to scale, and wherein:

FIG. 1 is a perspective view of a container embodiment of the invention facing the cover thereof;

FIG. 2 is a perspective view of the container embodiment of FIG. 1 facing the dispensing tray;

FIG. 3 is an exploded view of the container embodiment of FIG. 1 facing the interior of the dispensing tray;

FIG. 4 is an exploded view of the container embodiment of FIG. 1 facing the interior of the cover plate;

FIG. 5 is a perspective view of the container embodiment of FIG. 1 in a dispensing position;

FIG. 6 is a perspective view of the container embodiment of FIG. 1 in a closed position with the cover removed;

FIGS. 7-8 are perspective views of the container embodiment of FIG. 1 in a dispensing position with the cover removed;

FIGS. 9-10 are top views of the container embodiment of FIG. 1 with the cover removed and the middle plate shown as transparent such that the dispensing tray can be viewed;

FIG. 11 is a perspective view of another container embodiment of the present invention facing the dispensing tray;

FIG. 12 is an exploded view of the container embodiment of FIG. 11 facing the interior of the dispensing tray;

FIG. 13 is an exploded view of the container embodiment of FIG. 11 facing the interior of the cover plate;

FIG. 14 is a perspective view of the container embodiment of FIG. 11 with the cover plate removed;

FIG. 15 is a perspective view of the container embodiment of FIG. 11 in the dispensing position;

FIGS. 16-17 are cross-sectional perspective views of the container embodiment of FIG. 11;

FIGS. 18-19 are top views of the container embodiment of FIG. 11 having the cover removed and the middle plate shown as transparent such that the dispensing tray can be viewed;

FIGS. 20-21 are exploded views of an alternative container embodiment similar to the embodiment of FIG. 1 with an additional locking feature; and FIGS. 22-23 are exploded views of an alternative container embodiment similar to the embodiment of FIG. 11 with an additional locking feature.

DETAILED DESCRIPTION OF THE INVENTION

The present invention now will be described more fully hereinafter with reference to certain preferred embodiments. These embodiments are provided so that this disclosure will be thorough and complete, and will fully convey the scope of the invention to those skilled in the art. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The container embodiments described in the present application can be used to store and dispense any solid products, but are particularly well-suited for products designed for oral consumption. Exemplary consumable products include pharmaceutical products such as pills and tablets, cigarettes and other smoking products, smokeless tobacco products, candies, mints, gums and other confectionery products, snacks, and the like.

Exemplary tobacco products include pelletized tobacco products (e.g., compressed or molded pellets produced from powdered or processed tobacco, such as those formed into the general shape of a coin, cylinder, bean, pellet, sphere, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like.

Exemplary smokeless tobacco compositions that can be packaged in the containers of the invention are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; US 2005/0244521 to Strickland et al.; US 2006/0191548 to Strickland et al.; US 2007/0186942 to Strickland et al.; US 2008/0029110 to Dube et al.; and US 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. Various manners or methods for packaging smokeless tobacco products are set forth in US 2004/0217024 and US 2006/0118589 to Amarp et al.; WO 2005/016036 to Bjorkholm; WO 2006/034450 to Budd; WO 2007/017761 to Kutsch et al.; and WO 2007/067953 to Sheveley et al. All of the above-cited references are incorporated by reference herein in their entirety.

Smokeless tobacco compositions utilized as the product contained in the containers of the invention will often include such ingredients as tobacco (typically in particulate form), sweeteners, binders, colorants, pH adjusters, fillers, flavoring agents, disintegration aids, antioxidants, oral care additives, and preservatives. See, for example, US 2007/0186941 to Holton et al., which is incorporated by reference herein in its entirety.

The size and shape of the product to be stored and dispensed can vary. Exemplary product shapes include pills, tablets, spheres, strips, films, sheets, coins, cubes, beads, ovoids, obloids, cylinders, bean-shaped, sticks, or rods. Cross-sectional shape of the products can vary, and exemplary cross-sectional shapes include circles, squares, ovals, rectangles, and the like. The dimensions of the product will often vary depending on its shape. In one embodiment, the product is pellet or bean-shaped, and has a length and width in the range of about 3 mm to about 20 mm, more typically about 5 to about 12 mm. In another embodiment, the product is rod-shaped with a length in the range of about 50 to about 100 mm (more typically about 60 to about 80 mm) and a diameter of about 2 mm to about 8 mm (more typically about 3 mm to about 6 mm).

The shape of the outer surface of the containers of the invention can vary. Although the container embodiments illustrated in the drawings have certain contours, containers with other exterior surface designs could also be used. For example, the sides or edges of the containers of the invention could be flattened, rounded, or beveled, and the various surfaces or edges of the container exterior could be concave or convex. Further, the opposing sides, ends, or edges of the container can be parallel or non-parallel such that the container becomes narrower in one or more dimensions.

The dimensions of the containers described herein can vary without departing from the invention. However, in preferred embodiments, the containers of the invention can be described as having a size suitable for handheld manipulation and operation. Exemplary dimensions for such handheld embodiments include lengths in the range of about 25 mm to about 200 mm, more typically about 50 mm to about 150 mm, and most often about 80 mm to about 120 mm. Exemplary widths include the range of about 10 mm to about 100 mm, more typically about 20 mm to about 80 mm, and most often about 30 mm to about 60 mm. As used herein, length and width refer to the major dimensions of the container that define the major plane of the container. Exemplary depths for handheld container embodiments of the invention range from about 5 mm to about 50 mm, more typically about 8 mm to about 30 mm, and most often about 10 mm to about 20 mm.

The number of solid product units stored in the containers of the invention can also vary, depending on the size of the container and the size of the product units. Typically, the number of stored product units will vary from about 5 to about 100, more typically about 10 to about 50, and most often about 15 to about 30.

The material of construction of the container can also vary. Exemplary materials include metal, wood, and synthetic plastic materials. Polymeric materials that can be extruded and/or molded into desired shapes are typically utilized, such as polyethylene, polystyrene, polyamide, and the like.

In certain embodiments, the containers of the invention combine several advantageous features, such as child-resistance and metered dispensing of a product. In particular, certain embodiments of the containers of the invention include a child-resistant locking mechanism that releasably locks a dispensing chamber of the container in a closed and locked position. The locking mechanism can be released and a product dispensed using a series of manipulations including, for example, depressing a locking button and sliding a dispensing tray laterally to expose the product to be dispensed. The containers of the invention provide, in certain embodiments, metered dispensing of the product by providing a dispensing pathway sized for passage of a single unit of the product so that only a single unit of product can enter the dispensing chamber at one time.

Certain preferred embodiments of the invention are described herein as referring to metered dispensing of a single unit of product, which can be, for example, a single consumable unit of a smokeless tobacco product, a single consumable unit of a confectionery or snack product, or a single dosage unit of a pharmaceutical product. However, the invention encompasses embodiments where the product is dispensed in greater amounts, such as a plurality of units. For example, the dispensing aperture and dispensing chamber described herein could be sized to provide space for more than one unit of product if desired.

FIGS. 1-10 illustrate a container embodiment 10 that is particularly well-suited for storage and dispensing of a product having a pill or tablet shape. As shown in FIGS. 1-2, one embodiment of the container 10 of the invention includes a cover plate 12, which may include an optional depression 14 that enhances the user's ability to digitally manipulate the container during the unlocking and dispensing operations described herein. The container 10 also comprises a dispensing tray 22 and a middle plate 18 sandwiched between the cover plate 12 and the dispensing tray.

As shown in the exploded view of FIG. 3, the middle plate 18 has interior walls 30 that define a storage compartment 24 for storage of the products to be dispensed. The storage compartment 24 faces the cover 12, which also includes interior walls 38 that mate with the interior walls 30 of the middle plate 18 to enclose the storage compartment 24 (shown in FIG. 4).

The middle plate 18 also includes a dispensing aperture 26 that provides a dispensing pathway between the storage compartment 24 and the dispensing chamber 56 of the dispensing tray 22. Typically, the dispensing aperture 26 will be sized and configured to allow only a single unit of the stored product to pass through the aperture and into the dispensing chamber 56, although the aperture could also be configured to allow a larger defined number of product units to pass at one time.

The middle plate 18 also includes a locking button 28 that extends from the surface of the middle plate facing the dispensing tray 22. As shown in FIGS. 3 and 4, the locking button 28 is attached to the middle plate 18 in a hinged fashion such that the locking button is resiliently urged into a position distal from the middle plate 18, but which can be depressed towards the middle plate 18 by the user of the container 10.

The middle plate 18 also includes protrusions 50 that extend from the surface of the middle plate facing the cover 12. The protrusions 50 are configured to press-fit or snap into the holes 48 of the cover plate 12 shown in FIG. 4. This is one example of a method for fixedly engaging the middle plate 18 to the cover plate 12. However, other methods for affixing these two plates together may be substituted for the mechanism shown without departing from the present invention.

The middle plate also includes a lip 44 extending from one edge of the middle plate towards the dispensing tray 22. The lip 44, as shown in FIG. 4, includes a slot 52. The slot is configured to engage a tab 54 of the dispensing tray 22. The slot is sized to allow travel of the tab 54 as the container 10 is moved between a closed and locked position and an open dispensing position.

The middle plate 18 also includes a pivot connector 34 extending toward the dispensing tray 22 and configured to engage the pivot connector 36 of the dispensing tray. In the illustrated embodiment, the pivot connectors 34, 36 include flanged projections that interlock and allow rotational movement therebetween.

The dispensing tray 22 further includes exterior side walls 40 that extend toward the middle plate 18 and interior walls 58 that define the dispensing chamber 56. As shown, the dispensing chamber 56 preferably has an open end such that the product to be dispensed can slide out of the dispensing chamber and into the hand of the user. The dispensing tray 22 also includes an aperture 46 for receiving the locking button 28 such that the locking button is accessible from the exterior of the container 10. The dispensing tray 22 may further include a series of ridges 42 adjacent to the dispensing chamber 56 such that the ridges are operatively positioned to prevent movement of stored products through the aperture 26 in the middle plate 18 while the container is in the open dispensing position.

The dispensing tray 22 can further include a button chamber or area 60 adapted for housing the locking button 28 when the dispensing tray is in the dispensing position. This chamber 60 provides an area in which the locking button can reside after being depressed in order to unlock the container 10.

The lip 44 extending from one end of the middle plate 18 is adapted to extend over the open end of the dispensing chamber 56 when the container 10 is in the closed and locked position such that any product in the dispensing chamber 56 will remain in the dispensing chamber until the container is opened.

FIG. 5 shows the container of FIG. 1 in a dispensing position and illustrates a single unit 16 of the product positioned in the dispensing chamber 56.

FIGS. 6-8 illustrate the interaction between the middle plate and the dispensing tray as the container moves from a closed and locked position to an open dispensing position. Referring to FIG. 6, with the cover removed, the storage compartment 24 is shown having multiple product units 16 contained therein. The container in FIG. 6 is in the closed and locked position. As shown, the tab 54 of the dispensing tray 22 is positioned within the slot 52 of the middle plate 18. The tab 54 is in a first position while the container is in the closed and locked position.

FIGS. 7-8 illustrate the container in an open dispensing position with a single unit of product 16 in the dispensing chamber 56. As shown, as the dispensing tray 22 is rotated into the dispensing position, the tab 54 of the dispensing tray moves into a second position within the slot 52 of the middle plate in the same direction of travel as the dispensing chamber. The interaction between the tab 54 of the dispensing tray 22 and the slot 52 of the middle plate 18 controls movement between the locked position and the dispensing position and prevents rotational movement of the dispensing tray past the desired dispensing position.

As also shown in FIGS. 7-8, the ridges 42 of the dispensing tray 22 are positioned beneath the dispensing aperture 26 in the middle plate 18. Thus, as shown, no further units 16 of product can exit the storage compartment 24 while the container is in this position.

FIGS. 9-10 also illustrate movement of the container 10 between a closed position and a dispensing position by use of dashed lines to illustrate the movement of the dispensing tray 22 beneath the middle plate 18. Again, as shown, the tab 54 of the dispensing tray 22 moves from a first position to a second position as the dispensing tray moves from the closed position to the dispensing position, and the ridges 42 move into position beneath the dispensing aperture 26 as the dispending tray rotates between the two positions in order to prevent further product units 16 from exiting the storage compartment 24.

FIGS. 11-19 illustrate a second embodiment of a container 10 of the invention. Container 10' shown in FIGS. 11-19 is adapted for dispensing products in the shape of a rod. Other than the shape of the product, the container 10' illustrated in FIGS. 11-19 operates in a similar manner to the container embodiment 10 shown in FIGS. 1-10. Elements of container embodiment 10' that are analogous to elements of container 10 of FIGS. 1-10 are labeled with the same element number and the prime symbol.

In particular, it is noted that container 10' also contains a cover plate 12', a dispensing tray 22', and a middle plate 18', the middle plate including a lip 44' that extends over the end of the dispensing chamber 56' of the dispensing tray. The container 10' also includes a locking button 28' that is accessible from the exterior of the container and can be manipulated in order to unlock the container and allow movement of the container into the dispensing position. As shown in FIGS. 12-13, the storage chamber 24' is defined by interior walls 30' of the middle plate 18' and interior walls 38' of the cover plate 12'. Note that in this embodiment, the interior walls 38' of the cover plate 12' extend over the interior walls 30' of the middle plate 18' in an enveloping manner. Exterior side walls 40' of the dispensing tray extend toward the middle plate 18'.

As shown, in one embodiment, the cover plate 12' and the middle plate 18' are fixedly engaged by the interaction between tabs 48' and holes 50'. As with the embodiments set forth in FIGS. 1-10, container 10' includes engagement of pivoting connectors 34', 36', such that the dispensing tray 22' can rotate relative to middle plate 18'. A locking button 28' extends through an aperture 46' in the dispensing tray 22'. The dispensing chamber 56' is configured to receive a single rod-shaped unit. The middle plate 18' includes a rod-shaped aperture 26' that is in communication with the dispensing chamber 56' such that a single unit of product 16' can move into the dispensing chamber.

The container 10' also contains a plurality of ridges 42' adjacent to the dispensing chamber 56', which are positioned to prevent a product unit 16' from dropping into the dispensing chamber while the container is in the dispensing position. The ridges 42' move into a position beneath the dispensing aperture 26' when the dispensing tray 22' rotates into the dispensing position.

In operation, certain embodiments of the containers 10 and 10' described above can provide metered dispensing of a single unit of a product. The user of the container can manipulate the container as needed to ensure a single unit of the product is positioned within the dispensing chamber. This manipulation will typically involve simple movements of the container while in a closed and locked position to ensure gravity urges a product into the dispensing position. The locking button can then be depressed such that the locking button moves to a position within the interior of the dispensing tray and is no longer restricting rotational travel of the dispensing tray. With the locking button in this position, the user can then rotationally manipulate the dispensing tray such that the tray laterally rotates around its pivoting axis into a dispensing position where the dispensing chamber is open to the exterior of the container. In this position, the lip of the middle plate is no longer covering the open end of the dispensing chamber and the user can access the dispensing chamber and receive the unit to be dispensed.

The rotational movement of the dispensing tray between the closed and locked position and the open dispensing position involves rotation around a rotational axis that is substantially perpendicular to the major plane of the storage compartment, meaning the axis of rotation is substantially transverse to the longitudinal plane of the container. Further, as shown, the rotational movement of the dispensing tray results in lateral movement of the dispensing chamber away from the side of the container as opposed to movement away from the top or bottom surface of the container.

As noted previously, in the dispensing position, the container prevents further travel of product units from the storage compartment into a dispensing position. Once the product has been received by the user, the dispensing tray can be rotationally urged back into its original closed and locked position such that the locking button once again extends through the aperture in the dispensing tray and prevents further rotational movement. The above process can then be repeated as desired in order to dispense further units of the stored product.

An alternative container embodiment similar to the embodiment of FIGS. 1-10 is set forth in FIGS. 20-21 and an alternative container embodiment similar to the embodiment of FIGS. 11-19 is shown in FIGS. 22-23. As shown, the alternative embodiments include an additional locking feature that will be described by reference to FIGS. 20-21, with the understanding that analogous structural elements in FIGS. 22-23 are shown with a prime symbol. The additional locking feature includes a recess 74 in locking button 28, which is configured to receive a projection 68 of dispensing tray 22 when the container 10 is in the closed and locked position. The recess 74 may extend only partially through the hinged portion of the locking button 28 or can be in the form of an aperture extending completely through the hinged portion. The projection 68 is sized to fit within recess 74, and is preferably shaped to include a sloped or angled surface that facilitates movement of the locking button 28 from an unlocked position disengaged with the projection to a locked position wherein the projection resides within the recess. The cross-sectional shape of the recess 74 can vary depending on the shape of the projection 68, with exemplary shapes including circular and semicircular shapes.

Unlike the embodiment of FIGS. 1-10, the locking button 28 does not extend through an aperture in the dispensing tray 22. Instead, the dispensing tray includes a resilient and moveable flap 64 that is operatively positioned to engage the locking button 28 when the flap is pressed while the container is in the closed and locked position. As shown, the flap 64 is positioned adjacent to the projection 68. In operation, the user depresses the flap 64, which is configured to move toward the interior of the container and engage the locking button 28. The user deflects the flap 64 inwardly for a distance sufficient to disengage the projection 68 from the recess 74 in the locking button 28. At this point, the user can rotate the dispensing tray 22 in the same manner as explained with respect to the embodiment of FIGS. 1-10. The interior surface of the flap 64 can also include a projection 76, shown as a ridge in FIG. 23, which can facilitate engagement between the flap and the locking button 28 and reduce the distance the flap must travel to disengage the locking button from the projection 68.

In addition to the additional locking feature, the embodiment of FIGS. 20-21 is also distinct from the embodiment of FIGS. 1-11 in the structure of the storage compartment and the manner in which the storage compartment communicates with the dispensing chamber. As shown, the middle plate 18 includes a storage aperture 72 and side walls 66 projecting from the side of the middle plate facing the dispensing tray. Thus, the storage compartment is defined by both side walls 66 and opposing side walls 30 facing the cover plate (not shown), as well as the interior surfaces of both the cover plate and the dispensing tray. Unlike the embodiment of FIGS. 1-10, there is no aperture in middle plate 18 that communicates with the dispensing chamber 56. Instead, the storage compartment extends through the middle plate and a lateral pathway is created between the dispensing chamber 56 and the storage compartment. The embodiment of FIGS. 20-21 also includes a wall member 70 that blocks the dispensing pathway when the container is in the open dispensing position and prevents further movement of product units towards the dispensing chamber.

As part of the final packaging process, once the dispensing containers of the invention are filled with the desired product, the containers can be over-wrapped or over-sealed with a film material, or shrink-wrapped with such a material. The outer packaging material useful in accordance with the present invention can vary. Typically, the selection of the packaging material is dependent upon factors such as aesthetics, transparency, comfort of handling, desired barrier properties (e.g., so as to provide protection from exposure to oxygen or radiation, or so as to provide protection from loss of moisture), or the like. The packaging material preferably has the form of a film, such as a laminated film (e.g., a co-extruded laminated film). Representative materials that can be used to provide components or layers of film materials or laminated films include polyvinyl chloride, ethylene vinyl acetate co-polymer, oriented polypropylene, linear low density polyethylene, polyvinylidene dichloride, polyester terephthalate, ethylene methacrylic acid co-polymer, metallacene linear low density polyethylene, cellulosic materials (e.g., cellophane), and the like. Exemplary packaging materials can be plastic/metal films, plastic/metal films that are paper coated, plastic laminate films, or the like. US 2008/0029116 to Robinson et al. discloses examples of suitable packaging materials.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dispensing container, comprising:

a main body portion defining a storage compartment configured to store a plurality of units of a product to be dispensed, the storage compartment extending longitudinally within a plane, the main body portion comprising an outwardly-extending, resilient locking button; and a dispensing tray pivotally engaged with the main body portion and comprising a dispensing chamber in communication through a dispensing pathway with the storage compartment of the main body portion, the dispensing tray configured to pivot, around an axis of rotation substantially perpendicular to the longitudinal plane of the storage compartment, between a closed and locked position wherein the dispensing chamber is inaccessible from the exterior of the container and a dispensing position wherein the dispensing chamber is accessible from the exterior of the container, wherein the dispensing chamber defined by the dispensing tray is open at one end, and wherein the main body portion further comprises an outwardly-projecting lip that covers the open end of the dispensing chamber when the dispensing tray is in the closed and locked position, and wherein the dispensing tray further comprises a tab operatively positioned to slidingly engage a slot in the outwardly-projecting lip as the dispensing tray pivots between the closed and locked position and the dispensing position.

2. The container of claim 1, wherein the dispensing pathway is sized for passage of a single unit of the product.

3. The container of claim 1, wherein the dispensing tray further comprises an aperture through which the locking button of the main body portion extends when the dispensing tray is in the closed and locked position such that the locking button is accessible from the exterior of the container.

4. The container of claim 1, wherein the dispensing tray further comprises a button chamber adapted for housing the locking button when the dispensing tray is in the dispensing position.

5. The container of claim 1, wherein the dispensing tray further comprises one or more ridges positioned adjacent to the dispensing chamber and configured to block the dispensing pathway when the dispensing tray is in the dispensing position.

6. The container of claim 1, wherein the dispensing tray carries a tab that engages the main body portion and guides the pivoting action of the dispensing tray.

7. The container of claim 1, wherein the dispensing tray comprises a flap operatively positioned to engage the locking button when the dispensing tray is in the closed and locked position.

8. The container of claim 1, wherein the locking button comprises a recess facing the dispensing tray and the dispensing tray comprises a projection operatively positioned to engage the recess when the dispensing tray is in the closed and locked position.

9. The container of claim 1, wherein the locking button comprises a recess facing the dispensing tray and the dispensing tray comprises a moveable flap and an adjacent projection, the flap operatively positioned to engage the locking button when the dispensing tray is in the closed and locked position and the projection operatively positioned to engage the recess when the dispensing tray is in the closed and locked position, such that depressing the flap will depress the locking button and disengage the projection from the recess of the locking button.

10. The container of claim 1, wherein the storage compartment comprises a plurality of products.

11. The container of claim 1, wherein the product is characterized by a shape selected from the group consisting of pill, tablet, sphere, sheet, coin, cube, bead, ovoid, obloid, bean, stick, and rod.

12. The container of claim 1, wherein the product is selected from the group consisting of pharmaceutical products, smoking products, smokeless tobacco products, snack products, and confectionary products.

13. The container of claim 1, wherein the product is a smokeless tobacco product.

14. The container of claim 1, wherein the product is selected from the group consisting of pharmaceutical products, candies, mints, and gums.

15. A dispensing container, comprising:

a cover plate;

a middle plate fixedly attached to the cover plate and having a first surface facing the cover plate and an opposing surface facing away from the cover plate, the cover plate and the middle plate defining a storage compartment configured to store a plurality of units of a product to be dispensed, the storage compartment extending longitudinally within a plane, the middle plate comprising an aperture in communication with the storage compartment and sized for passage of at least one unit of the product, an outwardly-extending locking button projecting from the opposing surface and configured for movement between a locked position and an unlocked position and being resiliently urged into the locked position, and an outwardly-extending lip projecting from the opposing surface; and a dispensing tray pivotally engaged with the middle plate and comprising an open-ended dispensing chamber in communication with the aperture of the middle plate, the dispensing tray configured to pivot, around an axis of rotation substantially perpendicular to the longitudinal plane of the storage compartment, between a closed and locked position wherein the dispensing chamber is inaccessible from the exterior of the container and a dispensing position wherein the open end of the dispensing chamber is accessible from the exterior of the container, wherein the outwardly-extending lip of the middle plate covers the open end of the dispensing chamber when the dispensing tray is in the closed and locked position.

16. The container of claim 15, wherein the dispensing tray further comprising an aperture through which the locking button of the middle plate is urged when the dispensing tray is in the closed and locked position such that the locking button is accessible from the exterior of the container, and one or more ridges positioned adjacent to the dispensing chamber such that the one or more ridges prevent movement of a unit of the product through the aperture of the middle plate when the dispensing tray is in the dispensing position.

17. The container of claim 15, wherein the dispensing tray further comprises a button chamber adapted for housing the locking button when the dispensing tray is in the dispensing position.

18. The container of claim 15, wherein the dispensing tray further comprises a tab operatively positioned to slidingly engage a slot in the outwardly-projecting lip as the dispensing tray pivots between the closed and locked position and the dispensing position.

19. The container of claim 15, wherein the dispensing tray comprises a flap operatively positioned to engage the locking button when the dispensing tray is in the closed and locked position.

20. The container of claim 15, wherein the locking button comprises a recess facing the dispensing tray and the dispensing tray comprises a projection operatively positioned to engage the recess when the dispensing tray is in the closed and locked position.

21. The container of claim 15, wherein the locking button comprises a recess facing the dispensing tray and the dispensing tray comprises a moveable flap and an adjacent projection, the flap operatively positioned to engage the locking button when the dispensing tray is in the closed and locked position and the projection operatively positioned to engage the recess when the dispensing tray is in the closed and locked position, such that depressing the flap will depress the locking button and disengage the projection from the recess of the locking button.

22. The container of claim 15, wherein the storage compartment comprises a plurality of products.

23. The container of claim 15, wherein the product is characterized by a shape selected from the group consisting of pill, tablet, sphere, sheet, coin, cube, bead, ovoid, obloid, bean, stick, and rod.

24. The container of claim 15, wherein the product is selected from the group consisting of pharmaceutical products, smoking products, smokeless tobacco products, snack products, and confectionary products.

25. The container of claim 15, wherein the product is a smokeless tobacco product.

26. The container of claim 15, wherein the product is selected from the group consisting of pharmaceutical products, candies, mints, and gums.

* * * * *